US007045962B1

(12) United States Patent
Murai et al.

(10) Patent No.: US 7,045,962 B1
(45) Date of Patent: May 16, 2006

(54) GAS DISCHARGE PANEL WITH ELECTRODES COMPRISING PROTRUSIONS, GAS DISCHARGE DEVICE, AND RELATED METHODS OF MANUFACTURE

(75) Inventors: Ryuichi Murai, Toyonaka (JP); Yuusuke Takada, Katano (JP); Akira Shiokawa, Osaka (JP); Hiroyosi Tanaka, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/889,473

(22) PCT Filed: Jan. 21, 2000

(86) PCT No.: PCT/JP00/00281

§ 371 (c)(1),
(2), (4) Date: Jul. 17, 2001

(87) PCT Pub. No.: WO00/44025

PCT Pub. Date: Jul. 27, 2000

(30) Foreign Application Priority Data

Jan. 22, 1999 (JP) ..... 11-014801
Mar. 25, 1999 (JP) ..... 11-081132
Dec. 24, 1999 (JP) ..... 11-367660

(51) Int. Cl.
*H01J 17/49* (2006.01)

(52) U.S. Cl. ..... 313/582; 313/583; 313/587

(58) Field of Classification Search ..... 313/582–587, 313/609, 610; 315/169.1, 169.3, 169.4
See application file for complete search history.

(56) References Cited

U.S. PATENT DOCUMENTS

| | | | | |
|---|---|---|---|---|
| 5,587,624 | A | 12/1996 | Komaki | 313/584 |
| 5,640,068 | A | 6/1997 | Amemiya | 313/582 |
| 5,742,122 | A | 4/1998 | Amemiya et al. | 313/582 |
| 6,376,986 | B1 * | 4/2002 | Takagi et al. | 313/582 |
| 6,384,531 | B1 * | 5/2002 | Park et al. | 313/584 |
| 6,400,081 | B1 | 6/2002 | Matsumoto et al. | 313/582 |
| 6,433,489 | B1 | 8/2002 | Tanaka et al. | 315/169.4 |
| 6,495,957 | B1 * | 12/2002 | Kurogi et al. | 313/584 |
| 6,522,075 | B1 | 2/2003 | Koshio et al. | 313/586 |
| 6,541,922 | B1 * | 4/2003 | Shirozu | 315/169.4 |

(Continued)

FOREIGN PATENT DOCUMENTS

| | | |
|---|---|---|
| JP | 52137262 | 11/1977 |
| JP | 55143754 | 11/1980 |

(Continued)

*Primary Examiner*—Joseph Williams
*Assistant Examiner*—Kevin Quarterman

(57) ABSTRACT

A gas discharge panel to increase the illuminance efficiency and a method of manufacturing includes providing a plurality of cells arranged in a matrix between a pair of substrates. Pairs of display electrodes are arranged on an inner surface of one of the substrates and include two bus lines lying parallel to each other with one or more inner protrusions arranged within each cell relative to the bus lines. This arrangement provides a relatively short discharge gap between the pair of display electrodes.

43 Claims, 24 Drawing Sheets

U.S. PATENT DOCUMENTS

| | | | | |
|---|---|---|---|---|
| 6,545,412 | B1 | 4/2003 | Jang | 313/587 |
| 6,583,560 | B1 * | 6/2003 | Amemiya | 313/586 |
| 6,670,754 | B1 | 12/2003 | Murai et al. | 313/582 |
| 2003/0080682 | A1 | 5/2003 | Nagano | 313/582 |
| 2003/0146700 | A1 | 8/2003 | Amatsuchi | 313/582 |

FOREIGN PATENT DOCUMENTS

| | | |
|---|---|---|
| JP | 2148645 | 6/1990 |
| JP | 3250536 | 11/1991 |
| JP | 5121003 | 5/1993 |
| JP | 5290741 | 11/1993 |
| JP | 07-138601 | 5/1995 |
| JP | 07-2888087 | 10/1995 |
| JP | 895500 | 4/1996 |
| JP | 08-250029 | 9/1996 |
| JP | 8250029 | 9/1996 |
| JP | 9231907 | 9/1997 |
| JP | 10-321142 | 12/1998 |
| JP | 10-334811 | 12/1998 |
| JP | 11-109888 | 4/1999 |
| JP | 11272232 | 10/1999 |
| JP | 200011889 | 1/2000 |
| JP | 200021313 | 1/2000 |

* cited by examiner

GAS DISCHARGE PANEL WITH ELECTRODES COMPRISING PROTRUSIONS, GAS DISCHARGE DEVICE, AND RELATED METHODS OF MANUFACTURE

TECHNICAL FIELD

The present invention relates generally to a gas discharge panel and a gas display device used for TV displays and the like, and more particularly to a plasma display panel (PDP).

BACKGROUND ART

The demand in recent years for wide-screen displays with an image quality typified by high-vision has seen much research directed into cathode ray tube (CRT), liquid crystal display (LCD), and plasma display panel (PDP) technologies. CRTs are widely used in televisions and the like for their high resolution and image quality, although the large increases in device depth and weight that accompany increases in screen size mean that CRTs having a diagonal screen size exceeding 40 inches are not considered feasible.

LCDs by far exceed CRTs in terms of reduced energy consumption, device depth, and weight, and are now widely used as computer monitors, although the intricate construction of thin film transistors (TFT), the most common type of LCD, means that the manufacturing process is very involved. Increases in screen size consequently lead to a drop in yield rates, making the manufacture of LCDs over 20 inches not as yet feasible.

The attraction of PDPs, on the other hand, is the ability to combine a wide screen with a comparatively lightweight display. Increasing the screen size of PDPs has thus been a focus in the push to develop the displays of the future, and already available on the market are products having a diagonal screen size in excess of 60 inches.

PDPs are a type of gas discharge panel comprising two facing glass substrates, the inner surface of one of the glass substrates including plural pairs of display electrodes arranged in strips across a plurality of barrier ribs. Phosphors corresponding to the colors red, green, and blue are applied in order in the gap between adjacent barrier ribs, one color per gap, respectively, and the space between the two glass substrates is sealed. Phosphor illumination is then generated by discharging ultraviolet light (UV) within the discharge space, which is the sealed space between the two glass substrates and the interposed barrier ribs.

Direct current (DC) and alternating current (AC) are the two types of PDPs, distinguished by the power source used to drive them. AC PDPs, generally recognized as the most suitable for wide-screen application, are fast becoming the norm.

Due to contemporary demands for energy efficient electrical appliances, much of the interest in PDP development has centered on reducing the energy taken to drive them. This focus is particularly emphasized given the rise in energy consumption resulting from recent trends toward developing PDPs with larger screens and higher image definition.

One means of reducing the energy consumption of PDPs is to improve the illuminance efficiency, although measures that simply aim to cut the electricity supplied to PDPs are not viable because of resultant drops in illumination and display capacity caused by a reduction in the discharge capacity generated between the pairs of display electrodes. Improving the rate at which the phosphors change ultraviolet light into visible light is one way in which improvements in illuminance efficiency are being pursued, although much work still needs to be done in this area.

The issues discussed above relate not only to PDPs and other gas discharge panels but also to gas discharge devices (i.e. devices providing illumination by generating a discharge within a glass vessel filled with a discharge gas). The present difficulties in developing gas discharge panels and gas discharge devices lie, therefore, in securing a favorable discharge capacity while sustaining the illuminance efficiency.

DISCLOSURE OF INVENTION

In response to the above issues, the present invention seeks to provide (a) a gas discharge panel and a gas discharge device that secure a favorable discharge capacity while sustaining the illuminance efficiency, and (b) the related methods of manufacture.

The above objectives are to be achieved by a gas discharge panel having (a) a plurality of cells arranged in a matrix, each of the cells being filled with a discharge gas enclosed between a pair of substrates, and (b) pairs of display electrodes arranged on an inner surface of one of the substrates so as to extend in a row direction of the matrix. Each pair of display electrodes comprise (a) two bus lines lying parallel to each other and extending in the row direction of the matrix, (b) one or more inner protrusions arranged within each cell on an inner side of one or both of the bus lines so as to protrude toward an inner side of an opposite bus line, and (c) one or more outer protrusions arranged so as to protrude from an outer side of one or both of the bus lines.

According to the above construction, a shortest gap (discharge gap) between each pair of display electrodes is either the gap between one of the bus lines and the inner protrusions provided on the opposite bus line or the gap between the inner protrusions provided on both of the bus lines. Discharge is generated in the shortest gap. By concentrating the electric charge within the shortest gap during the discharge period, it is possible to keep the discharge firing voltage below existing levels. Also, the generated discharge gradually expands to the outer protrusions, allowing a sustain discharge (surface discharge) to be secured over a wide area. Thus the present invention allows for an excellent discharge capacity to be achieved while improving the illuminance efficiency above existing levels. According to the present invention, it is also possible to arrange the inner protrusions on each of the bus lines so that the ends are out of alignment along the row direction of the matrix.

In summary, the excellent discharge capacity and improved illuminance efficiency achieved by the present invention are due to the favorable way in which the discharge capacity expands along the row and column directions of the matrix (i.e. parallel to the surface of the substrates) at the time of sustaining the discharge between the pairs of display electrodes.

Figure 9:
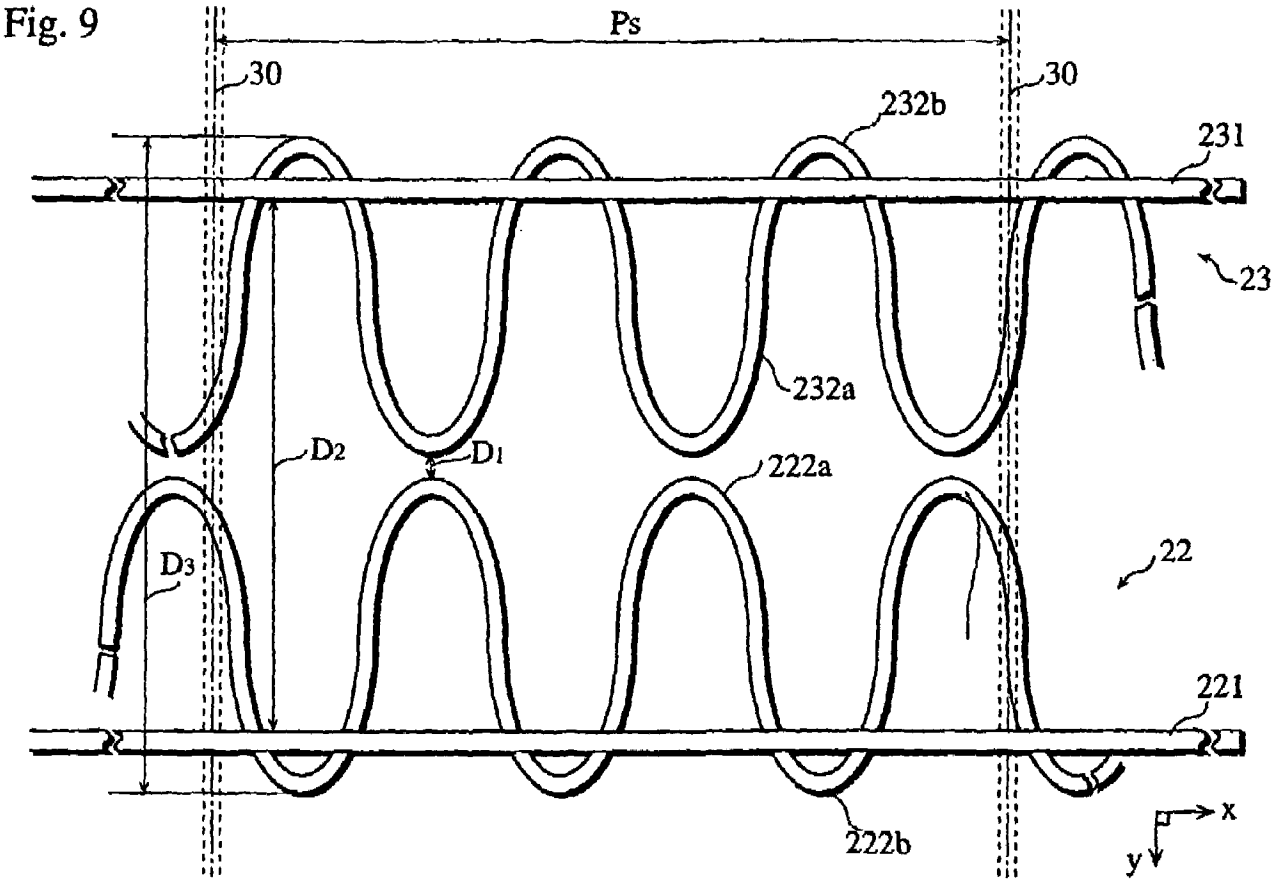
Figure 10:
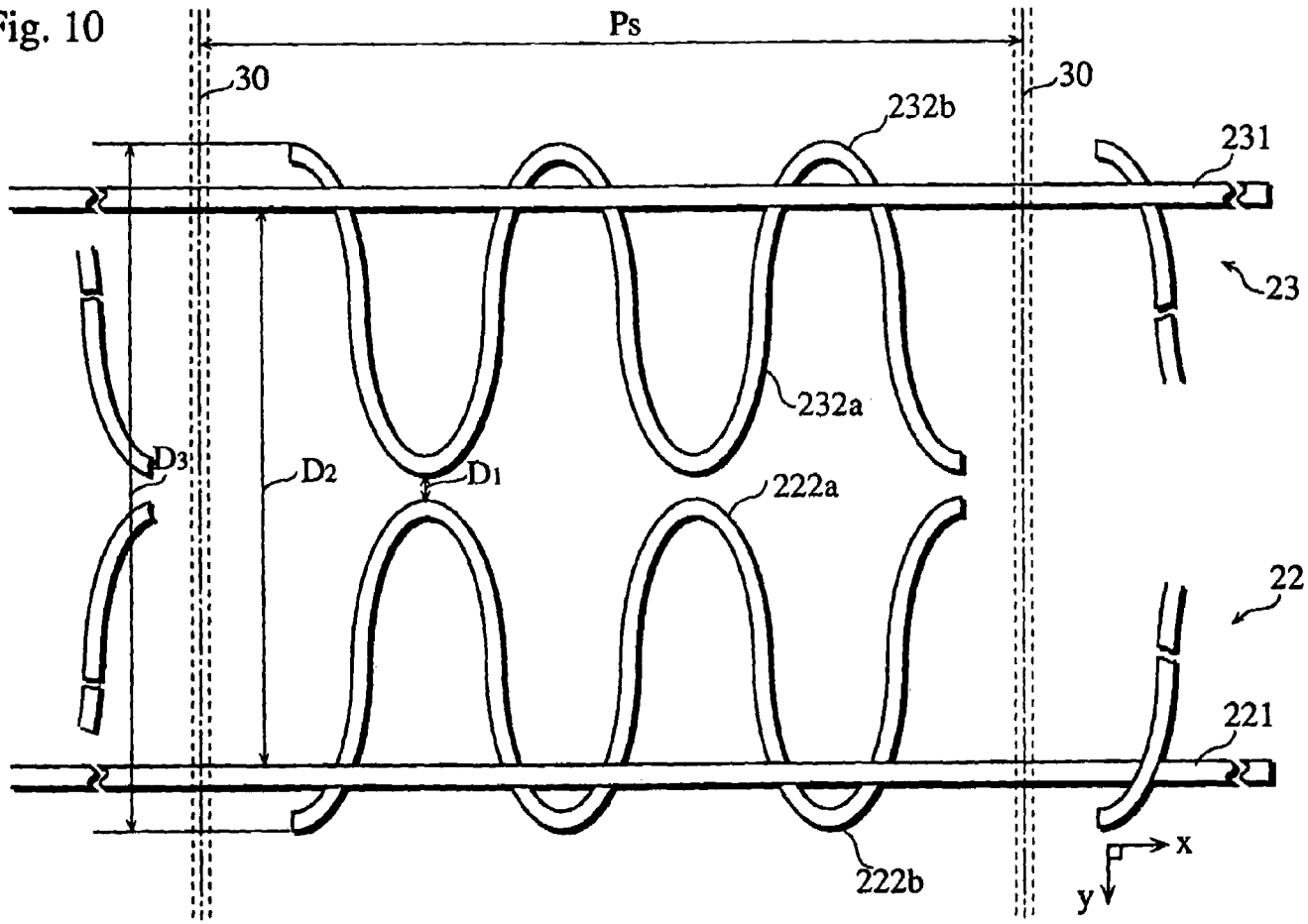
Figure 11:
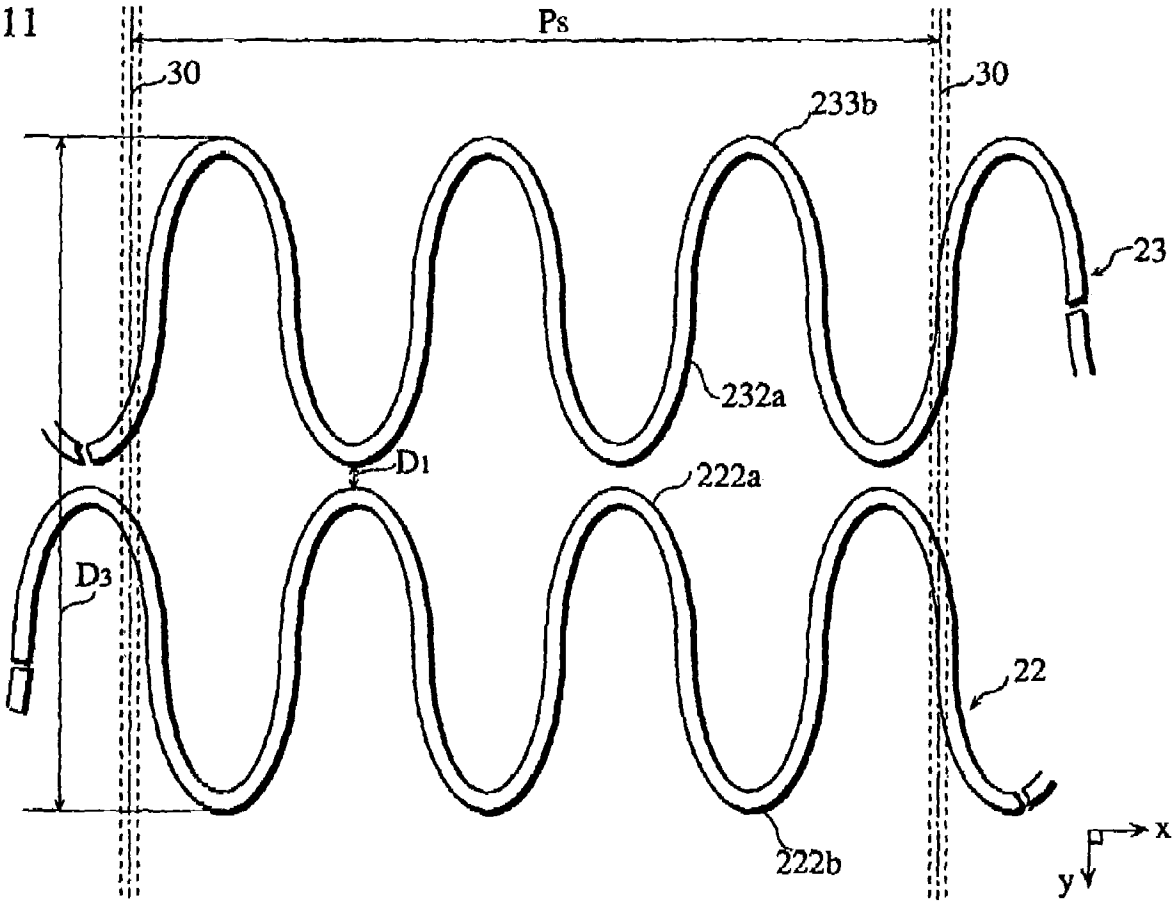
Figure 12:
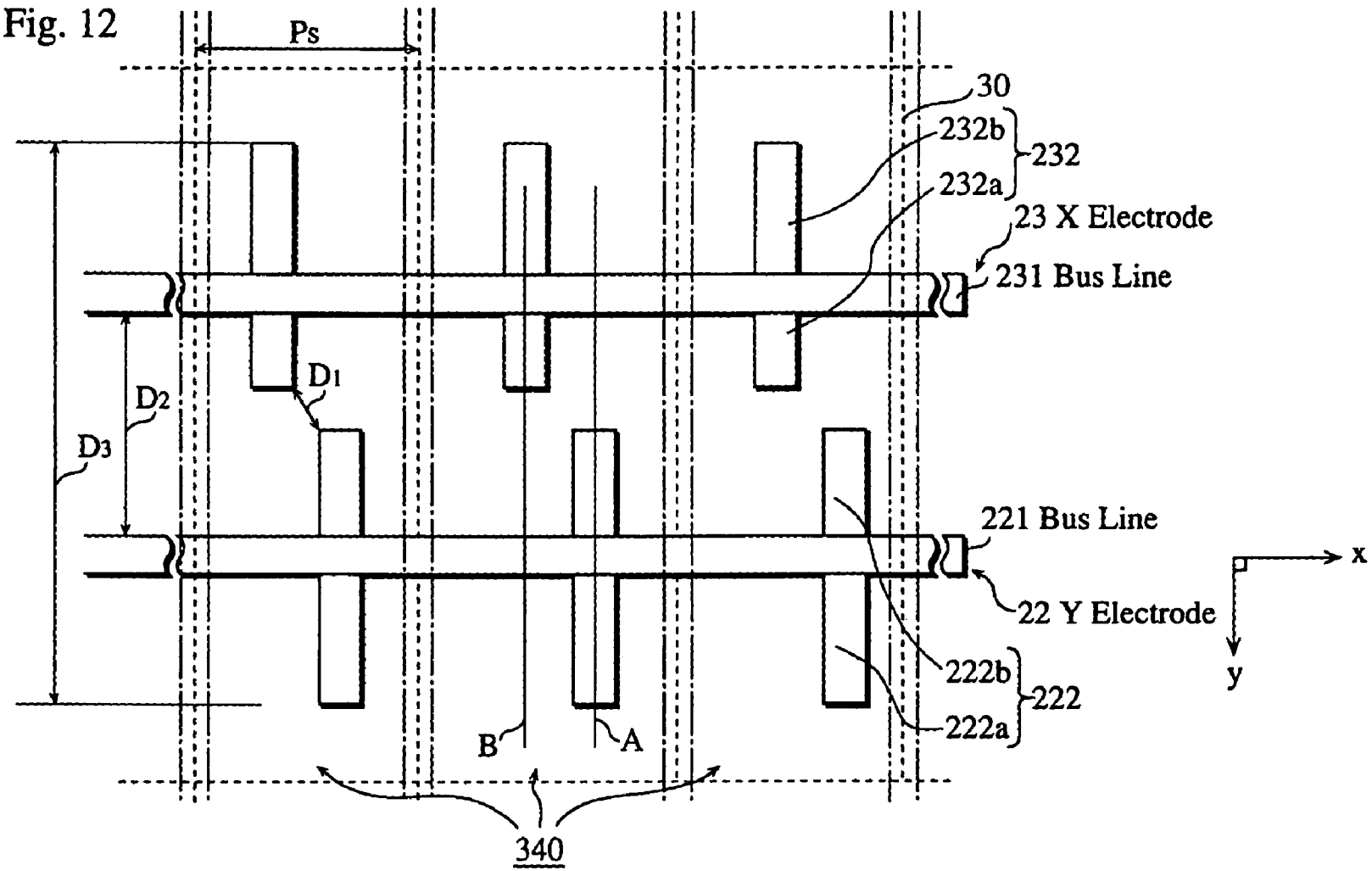
Figure 13:
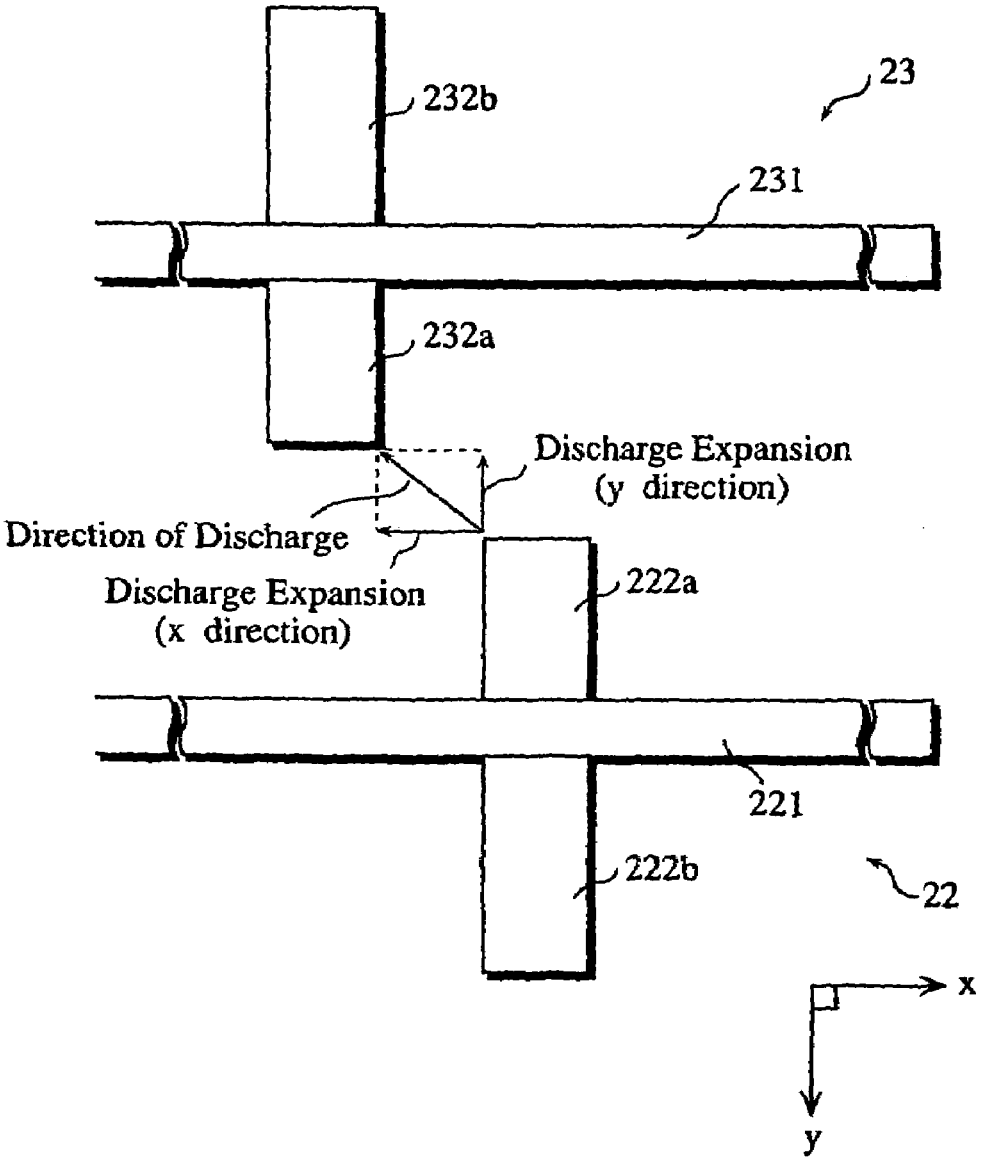
Figure 14:
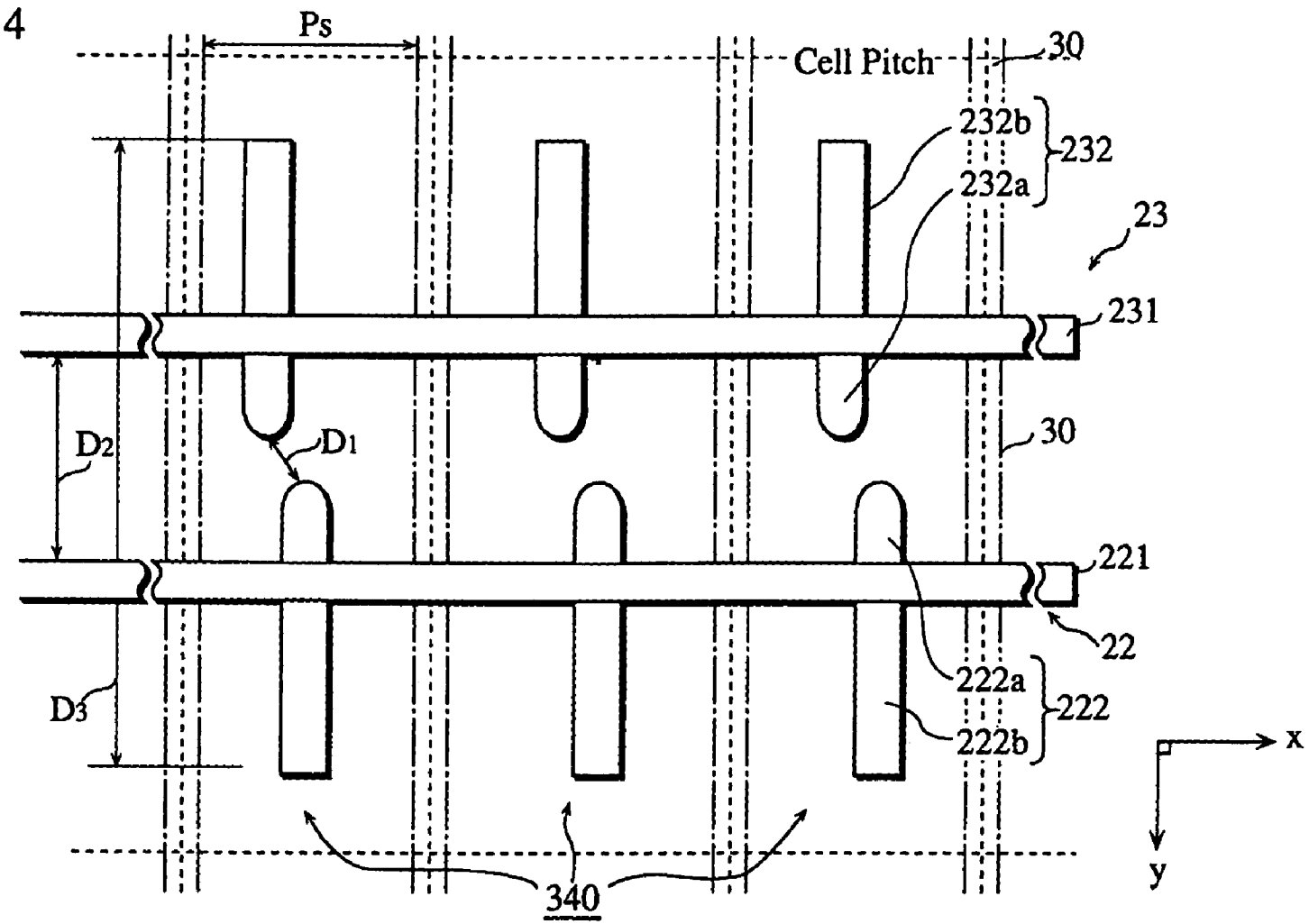
Figure 15:
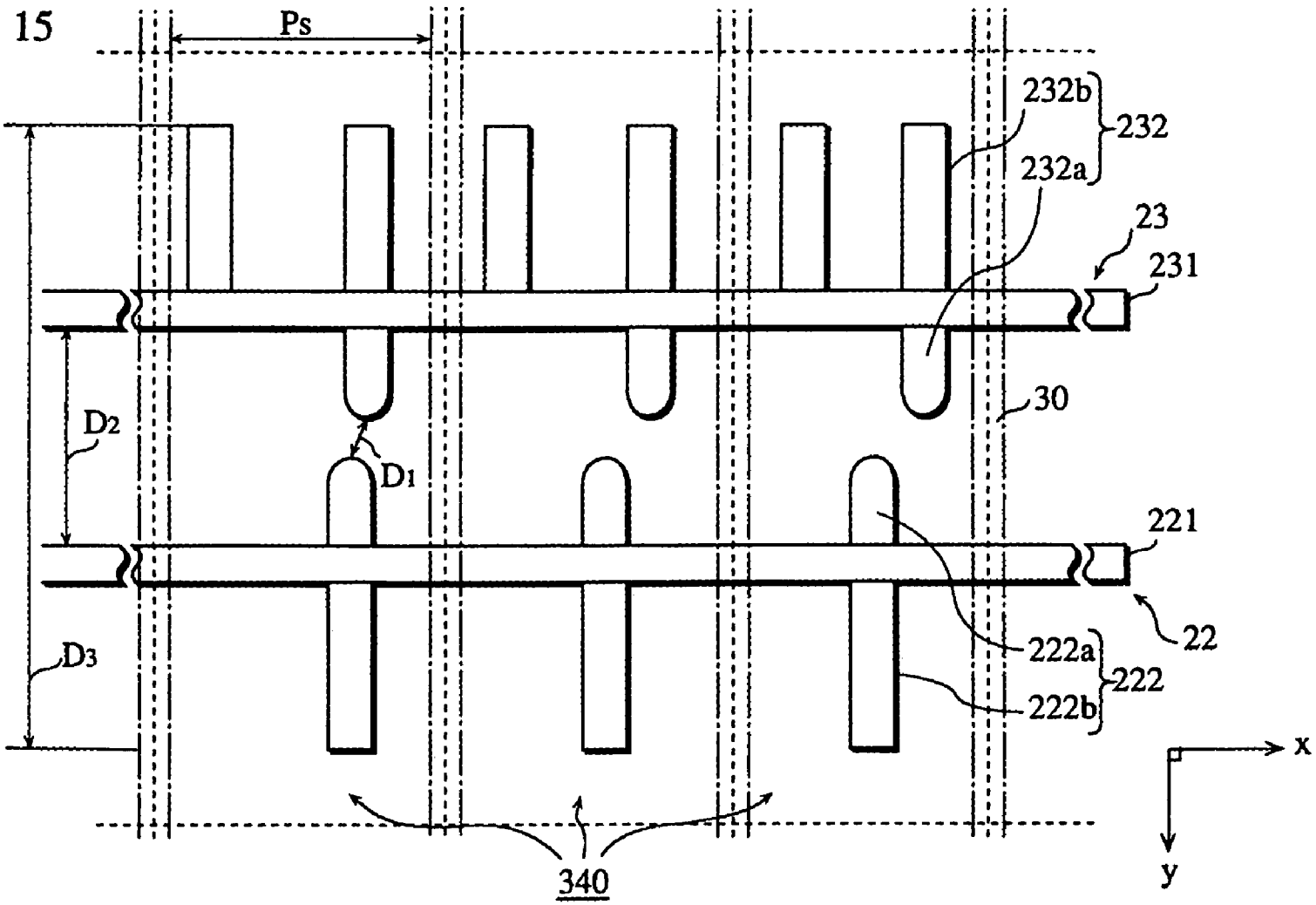
Figure 16:
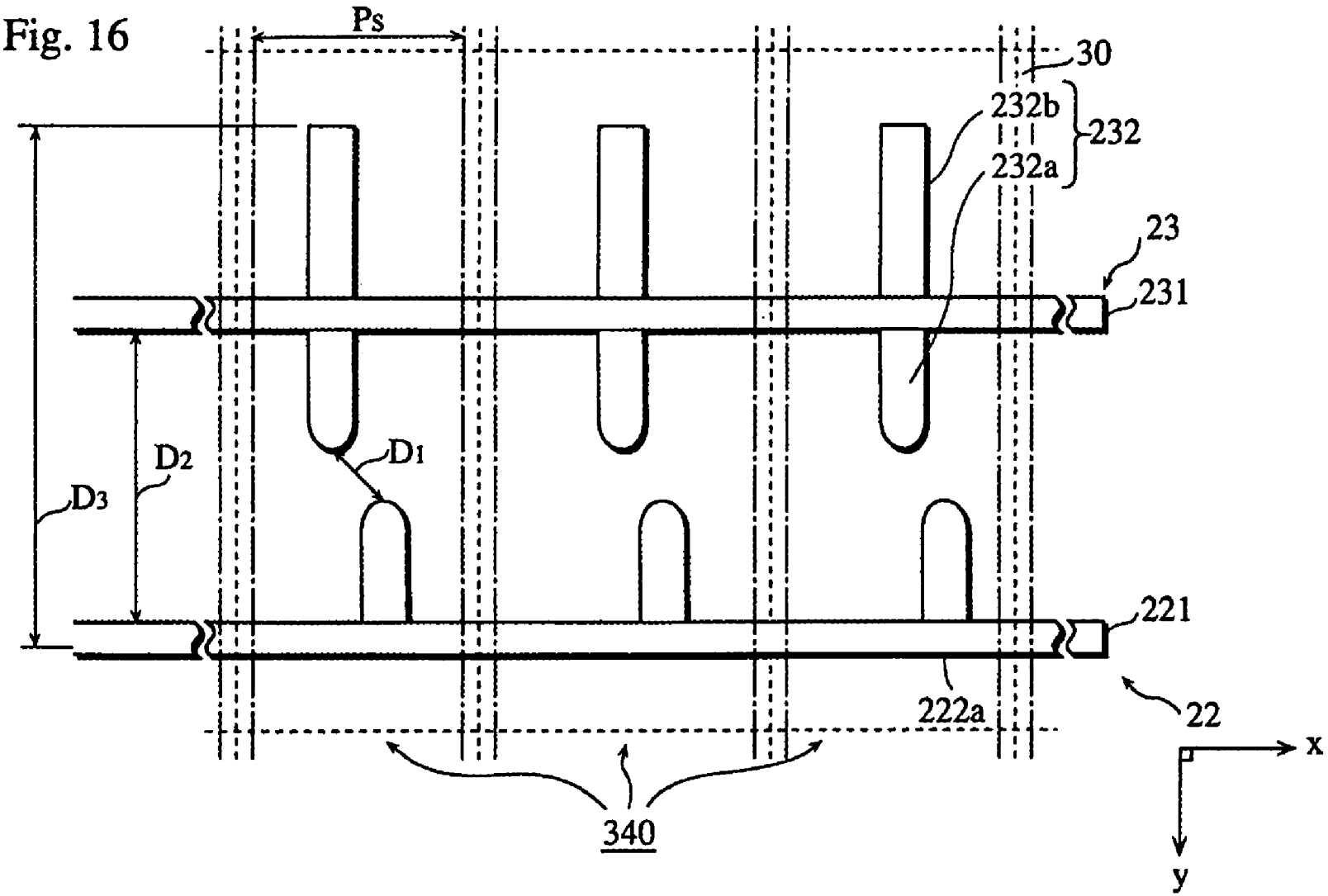
Figure 17:
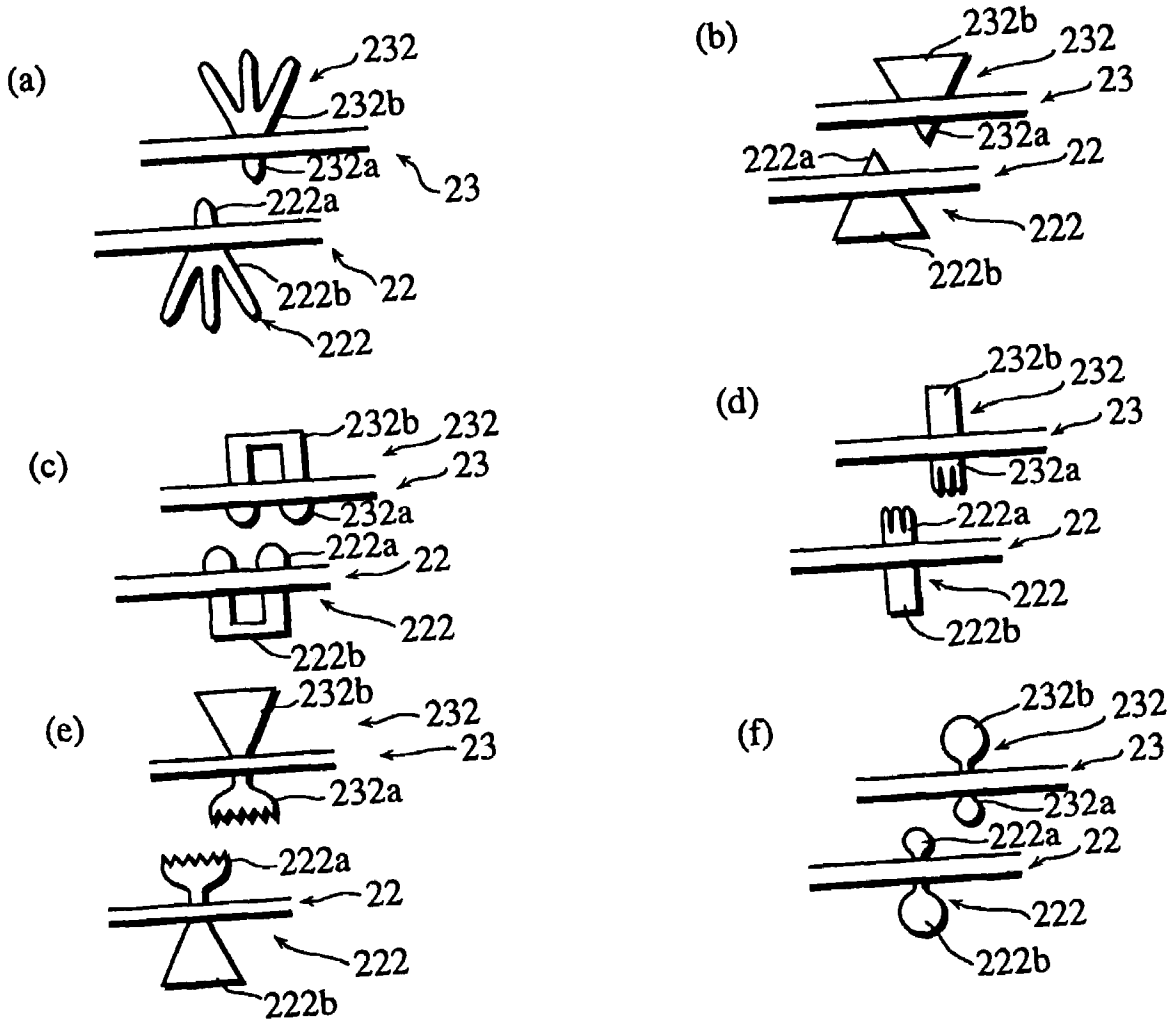
Figure 18:
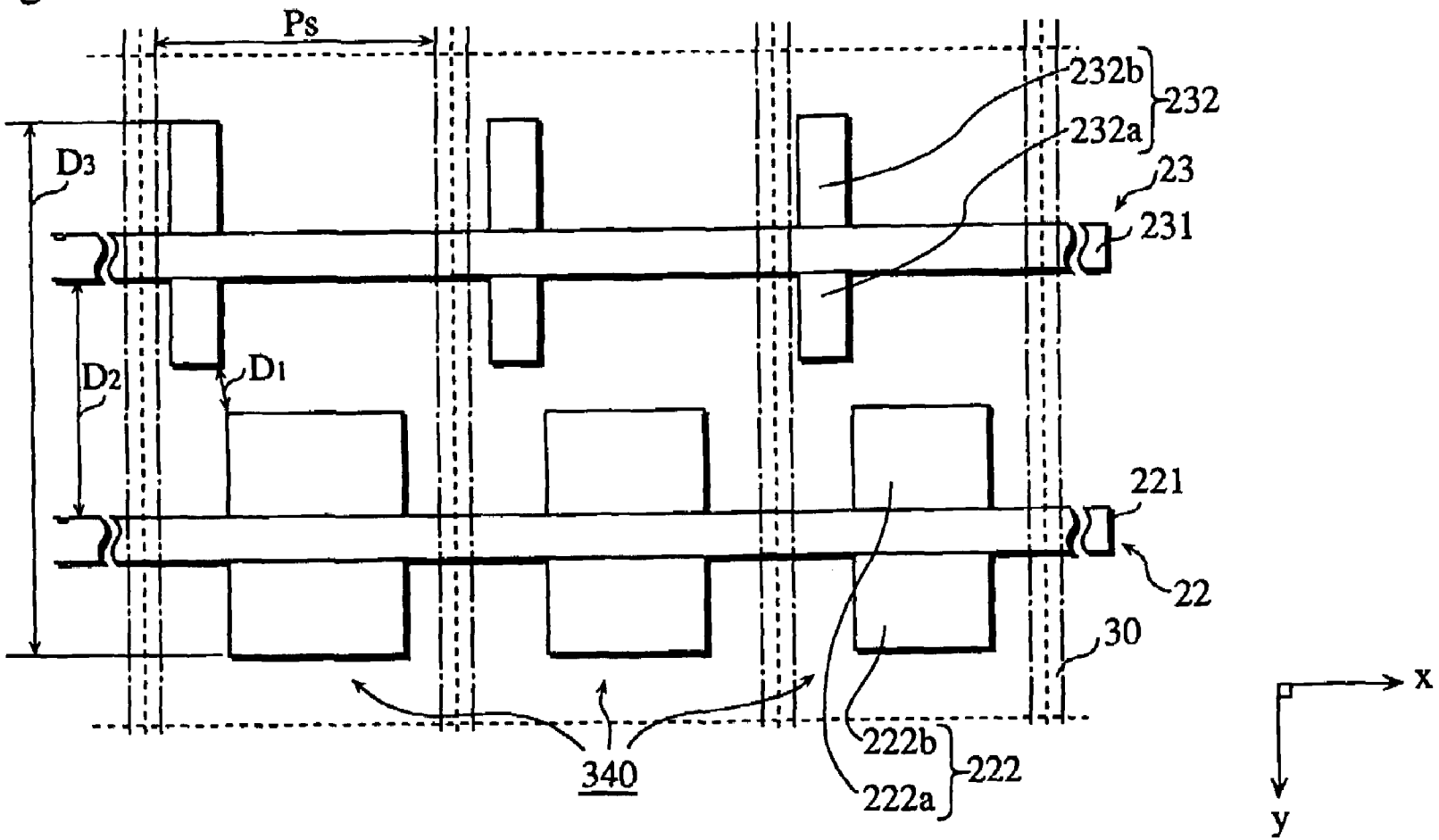
Figure 19:
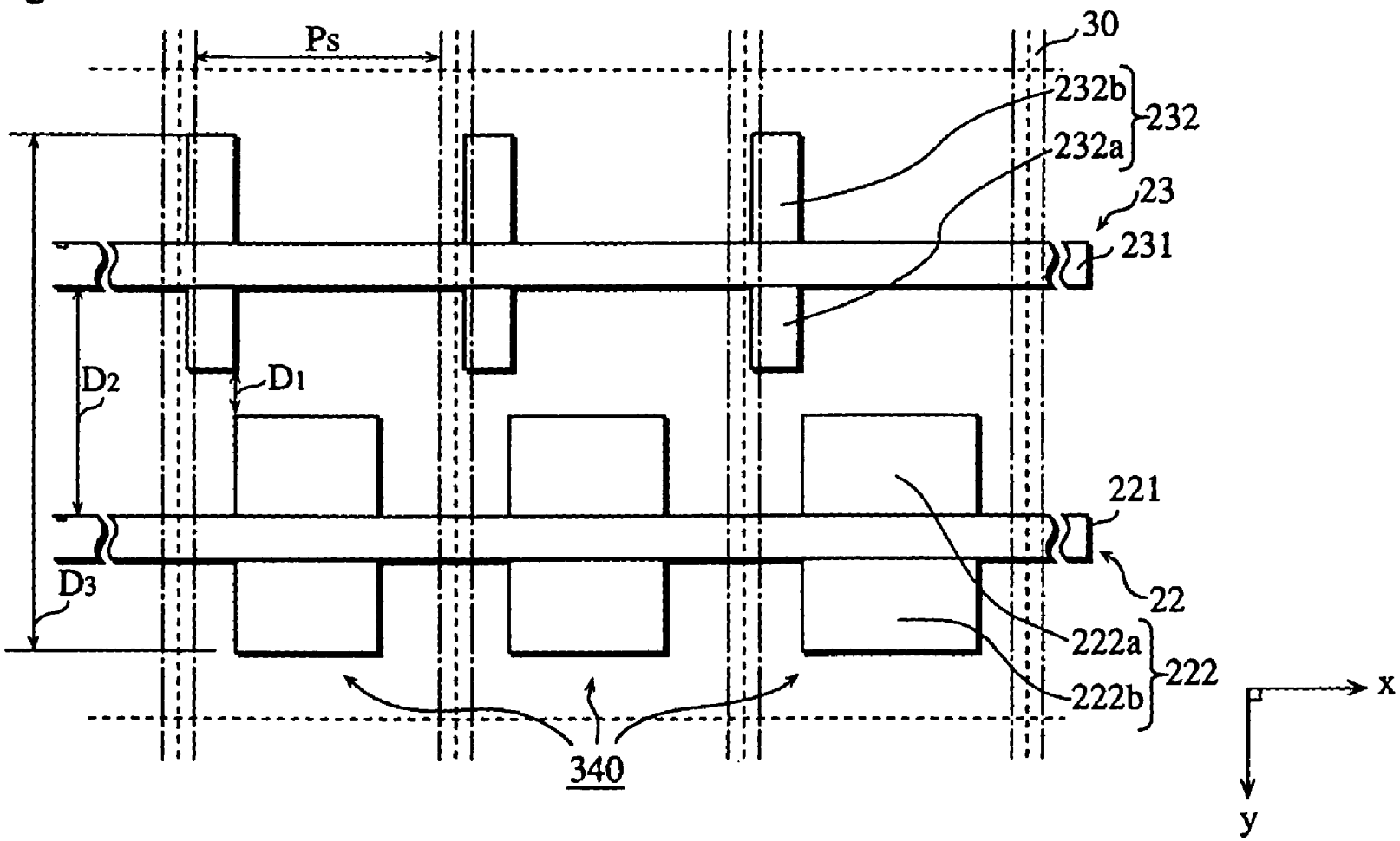
Figure 20:
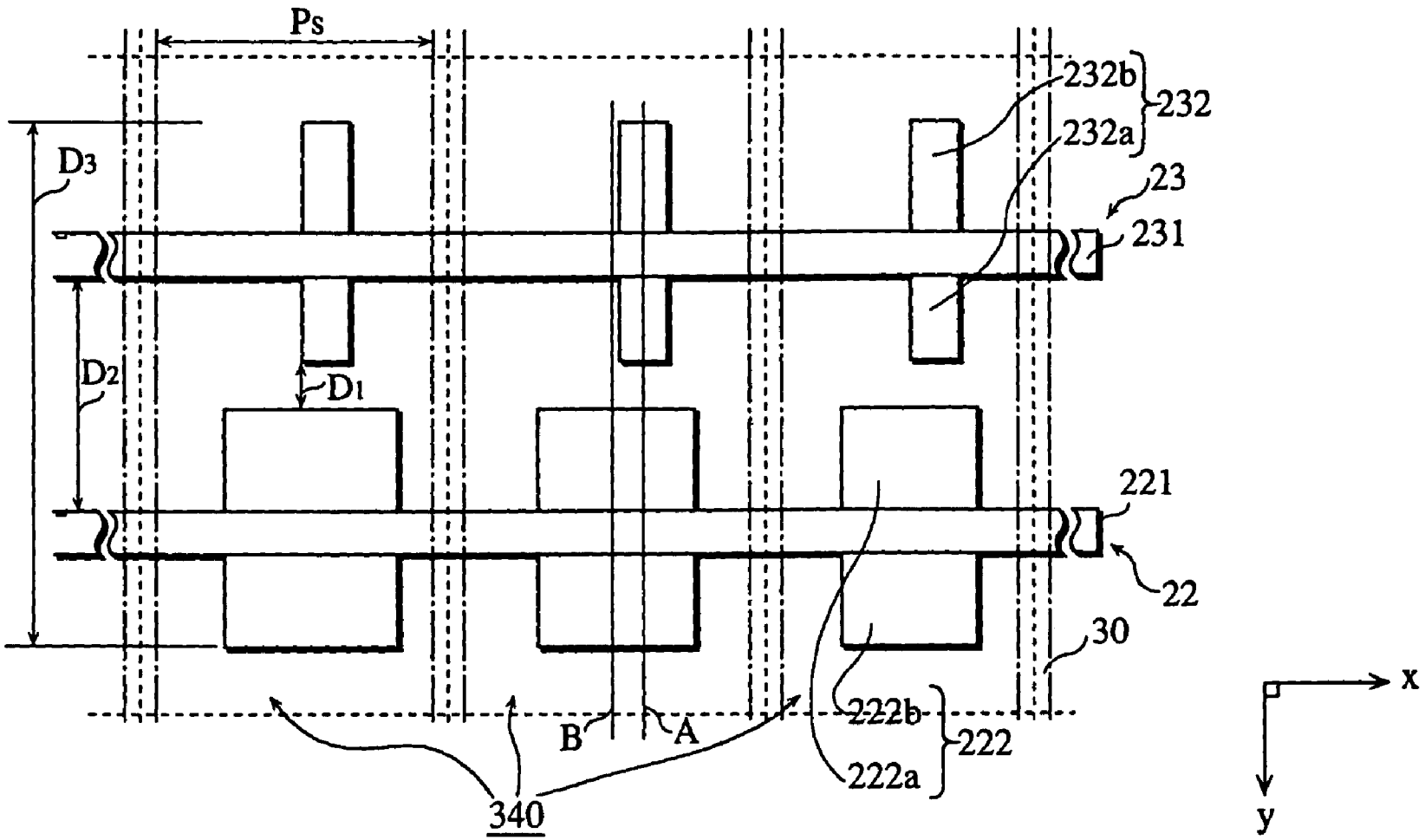
Figure 21:
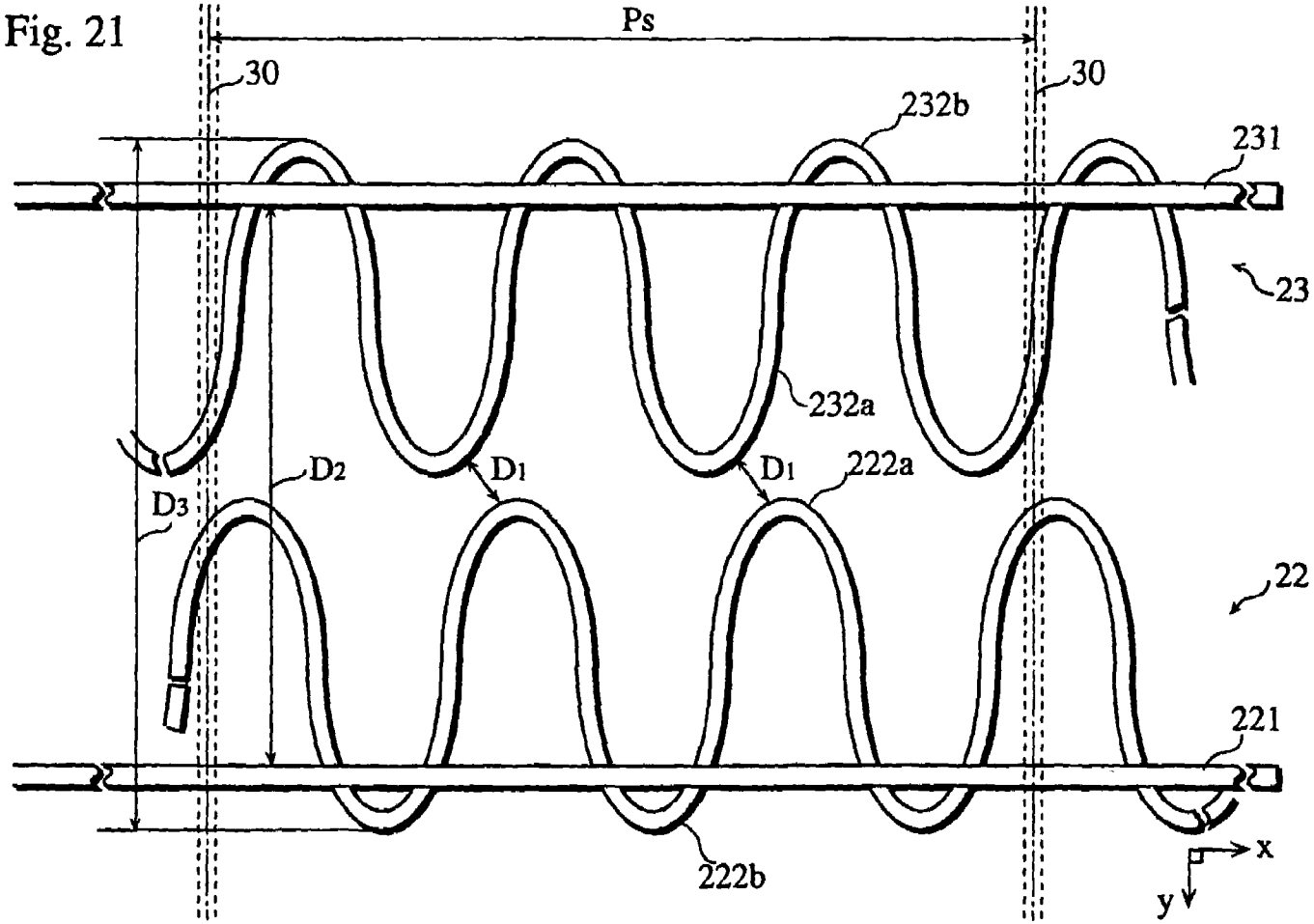
Figure 22:
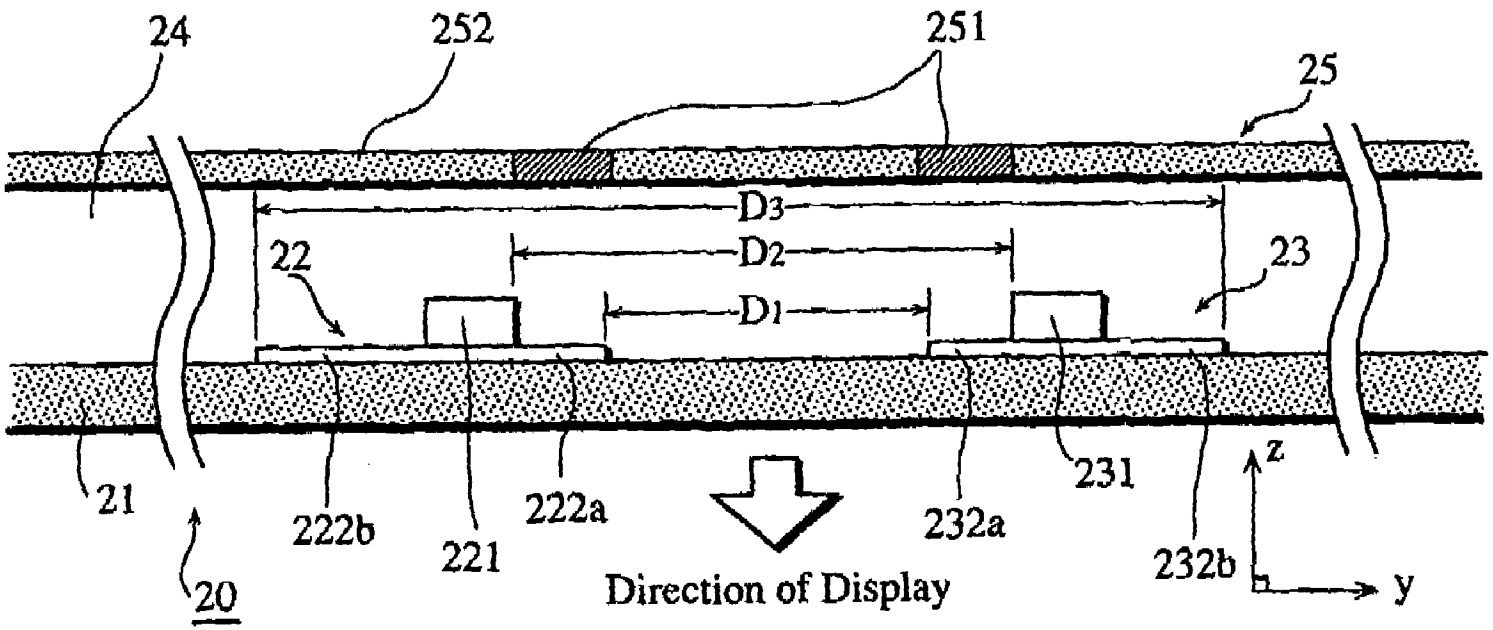
Figure 23:
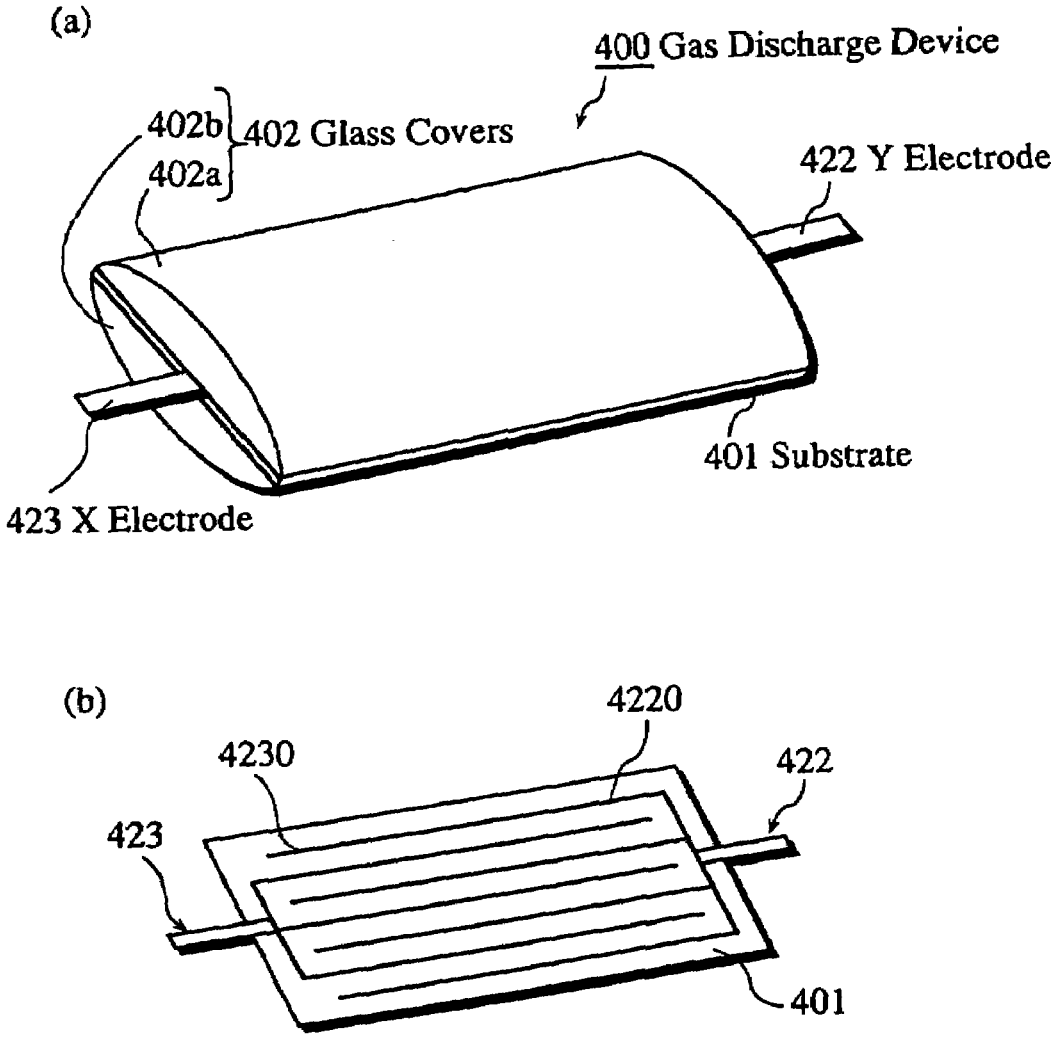
Figure 24:
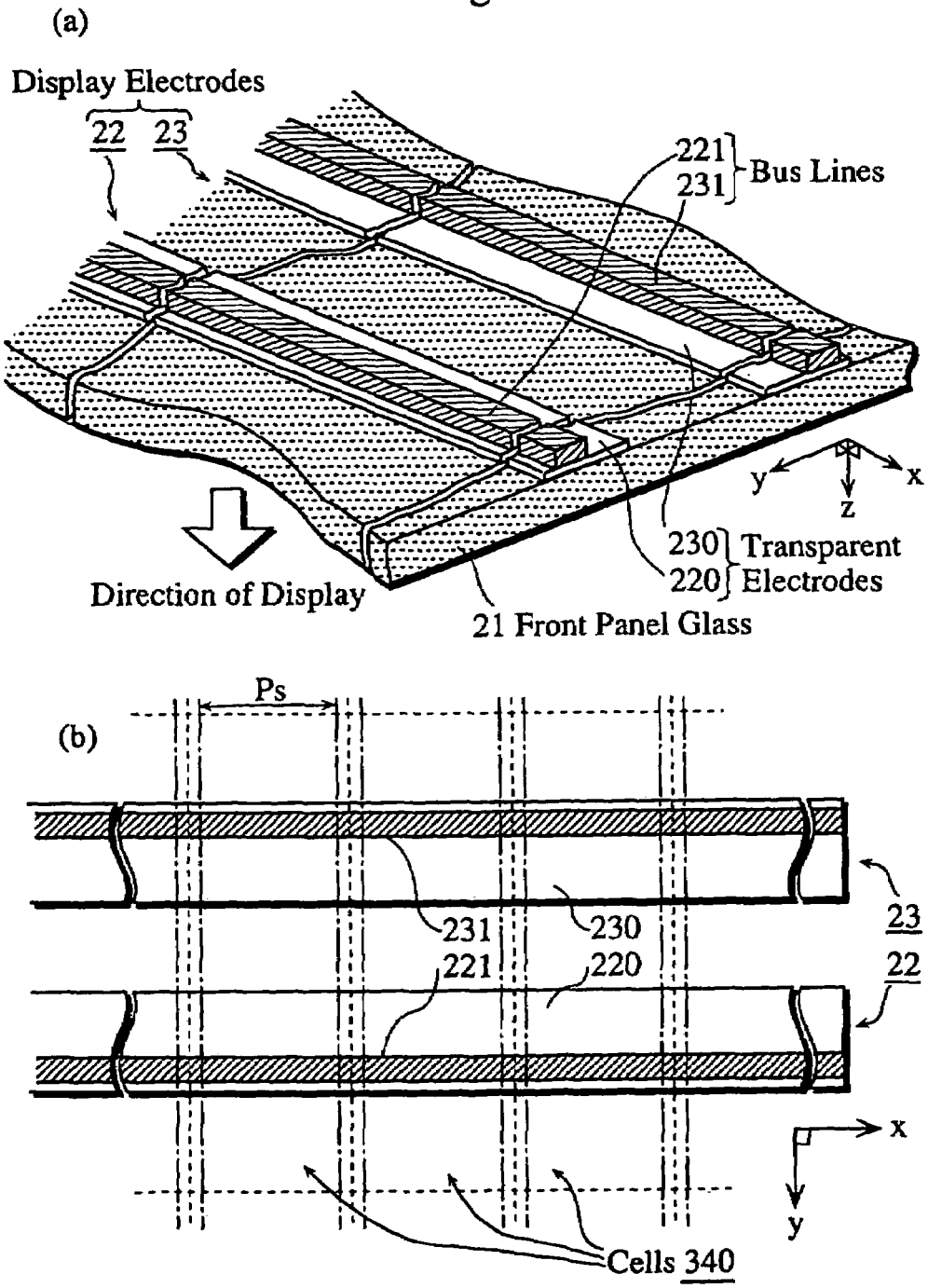

(a) is a frontal illustration of a variation of the display electrodes (variation 1-4) of the first embodiment;

(b) is a frontal illustration of a variation of the display electrodes (variation 1-5) of the first embodiment;

(c) is a frontal illustration of a variation of the display electrodes (variation 1-6) of the first embodiment;

(d) is a frontal illustration of a variation of the display electrodes (variation 1-7) of the first embodiment;

(e) is a frontal illustration of a variation of the display electrodes (variation 1-8) of the first embodiment;

(f) is a frontal illustration of a variation of the display electrodes (variation 1-9) of the first embodiment;

FIG. 9 is a frontal illustration of a variation of the display electrodes (variation 1-10) of the first embodiment;

FIG. 10 is a frontal illustration of a variation of the display electrodes (variation 1-11) of the first embodiment;

FIG. 11 is a frontal illustration of a variation of the display electrodes (variation 1-12) of the first embodiment;

FIG. 12 is a frontal illustration of the display electrodes of the PDP of the second embodiment;

FIG. 13 is an enlarged partial view of the display electrodes of the second embodiment;

FIG. 14 is a frontal illustration of a variation of the display electrodes (variation 2-1) of the second embodiment;

FIG. 15 is a frontal illustration of a variation of the display electrodes (variation 2-2) of the second embodiment;

FIG. 16 is a frontal illustration of a variation of the display electrodes (variation 2-3) of the second embodiment;

FIG. 17 is a frontal illustration of a variation of the display electrodes (variation 2-4) of the second embodiment;

(a) is a frontal illustration of a variation of the display electrodes (variation 2-4) of the first embodiment;

(b) is a frontal illustration of a variation of the display electrodes (variation 2-5) of the first embodiment;

(c) is a frontal illustration of a variation of the display electrodes (variation 2-6) of the second embodiment;

(d) is a frontal illustration of a variation of the display electrodes (variation 2-7) of the first embodiment;

(e) is a frontal illustration of a variation of the display electrodes (variation 2-8) of the second embodiment;

(f) is a frontal illustration of a variation of the display electrodes (variation 2-9) of the second embodiment;

FIG. 18 is a frontal illustration of a variation of the display electrodes (variation 2-10) of the second embodiment;

FIG. 19 is a frontal illustration of a variation of the display electrodes (variation 2-11) of the second embodiment;

FIG. 20 is a frontal illustration of a variation of the display electrodes (variation 2-12) of the second embodiment;

FIG. 21 is a frontal illustration of a variation of the display electrodes (variation 2-13) of the second embodiment;

FIG. 22 is a cross-sectional view of a section of the PDP of the third embodiment;

FIG. 23 shows an example construction of a gas discharge device according to the embodiments of the present invention;

(a) is a perspective view of the entire gas discharge device;

(b) shows the electrode construction of the gas discharge device;

FIG. 24 is a frontal illustration of the display electrodes of an existing PDP;

(a) is a perspective view of a section of the display electrodes of an existing PDP;

(b) is a frontal illustration of the display electrodes of an existing PDP.

BEST MODE FOR CARRYING OUT THE INVENTION

First Embodiment

Figure 1:
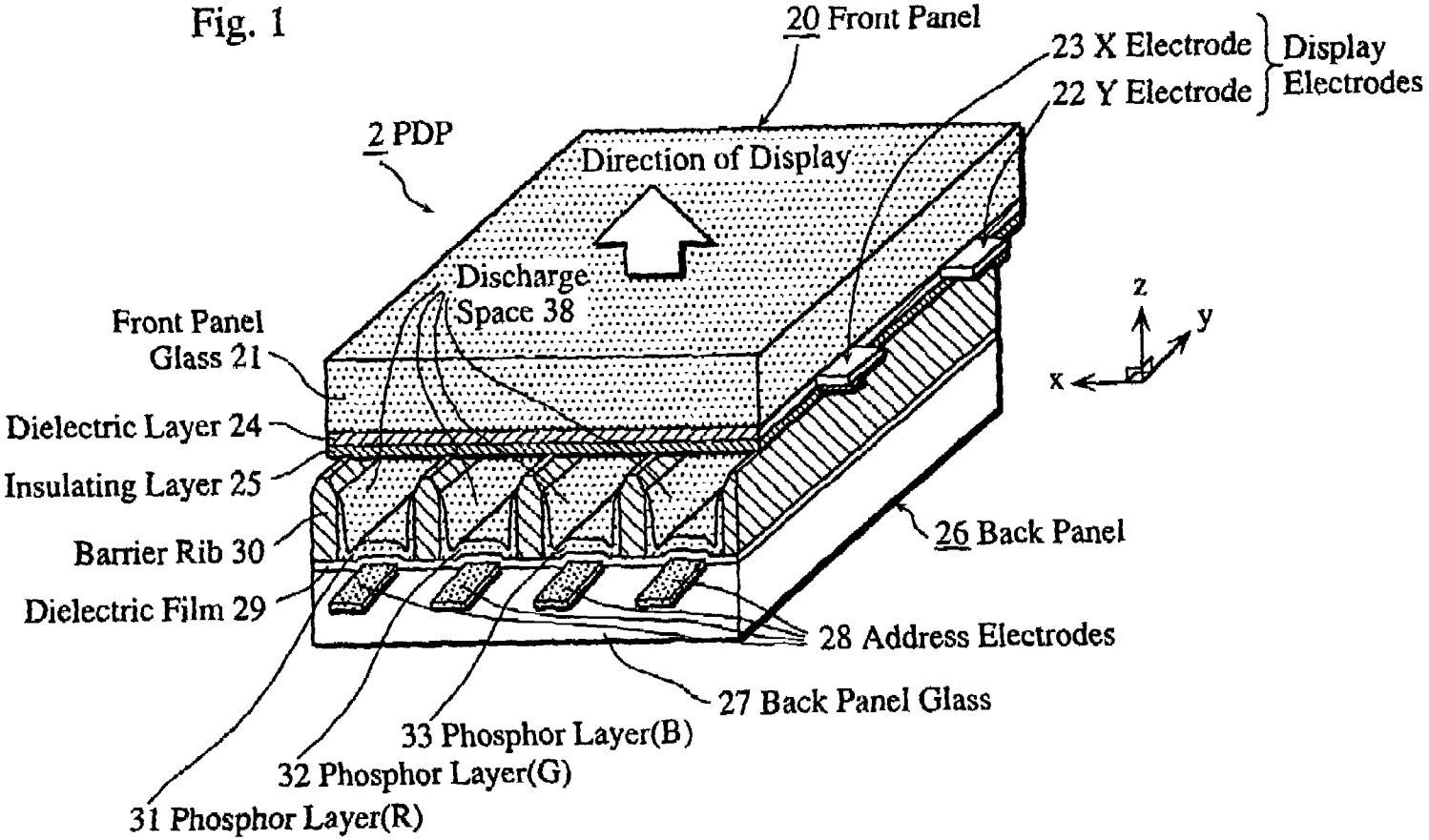
FIG. 1 is a cross-sectional perspective view of a section of the PDP of the first embodiment.

FIG. 1 is a cross-sectional perspective view showing a principal construction of an AC PDP module (hereafter "PDP 2") of a PDP display apparatus, being an example gas discharge apparatus of the first embodiment. In FIG. 1, the PDP 2 is thick in a z direction and the surface of the PDP 2 runs parallel to the xy plane. This description applies to all the figures discussed below. The PDP display apparatus of the first embodiment is divided broadly into the PDP 2 and the panel driving part 1 described below. The construction of a panel driving part 1 is the same with respect to the first, second, and third embodiments, and to each of the variations 1-1~1-12 and 2-1~2-13.

As shown in FIG. 1, the PDP 2 is formed by a front panel 20 and a back panel 26 arranged so as to face each other. A front panel glass 21 forming the substrate of the front panel 20 is arranged on one side with plural pairs of display electrodes 22 and 23 (Y electrode 22, X electrode 23) running parallel in the x direction, surface discharge being conducted between each pair of display electrodes 22 and 23. A detailed explanation of the display electrodes 22 and 23 is given below. The entire surface of the front panel glass 21 arranged with display electrodes 22 and 23 is covered with a dielectric layer 24, and the dielectric layer 24 is then covered in turn with an insulating layer 25.

One side of a back panel glass 27 forming the substrate of the back panel 26 is provided, in evenly spaced strips, with a plurality of address electrodes 28 arranged so as to extend in the y direction. The entire surface of the back panel glass 27 is then covered with a dielectric film 29, covering over the address electrodes 28. Barrier ribs 30 are arranged in the space between adjacent address electrodes 28, and phosphor layers 31~33 corresponding to the colors red (R), green (G), and blue (B) are formed on the sides of adjacent barrier ribs 30 and the surface of the dielectric film 29 lying between adjacent barrier ribs. The RGB phosphor layers 31~33 are arranged serially in the x direction. This completes the process for enabling image display to be generated on the PDP 2.

The front panel 20 and back panel 26 face each other so that the display electrodes 22 and 23 lie orthogonally to the address electrodes 28, the periphery of both panels 20 and 26 coming into contact and being sealed. A discharge gas (enclosed gas), being an inert gas such as He, Xe, or Ne, is then enclosed within the space between the panels 20 and 26 at a predetermined pressure (commonly in a 400~800 Pa range). The discharge gas is enclosed at the predetermined pressure (approx. $266\times10^3$ Pa in the PDP 2) after a vacuum has been created within the discharge space 38 via a chip tube (not shown in the figures) disposed on the back panel 26.

If the pressure of the discharge gas is greater than the atmospheric pressure, it is desirable to have the front panel 20 and back panel 26 come into contact with each other at the top of the barrier ribs 30. The area of each of cells 340 (shown in FIG. 4 and subsequent figures) contributing to image display is the area in which a pair of display electrodes 22 and 23 cross-over a single address electrode with the discharge space (existing between adjacent barrier ribs 30) sandwiched therebetween. To drive the PDP 2, the panel driving part 1 generates a discharge at the address electrodes 28 and either the display electrodes 22 or 23 (the X electrodes 23 according to the first embodiment, the X electrodes and Y electrodes commonly being referred to as "scan electrodes" and "sustain electrodes," respectively). As a result of this discharge, each of the cells 340 is rewritten, discharge is fired between the pairs of display electrodes 22 and 23, and a short-wave ultraviolet light (having dominant wavelengths of 47 nm and 173 nm) is generated. The phosphor layers 31–33 are thus illuminated and image display is generated.

Figure 2:
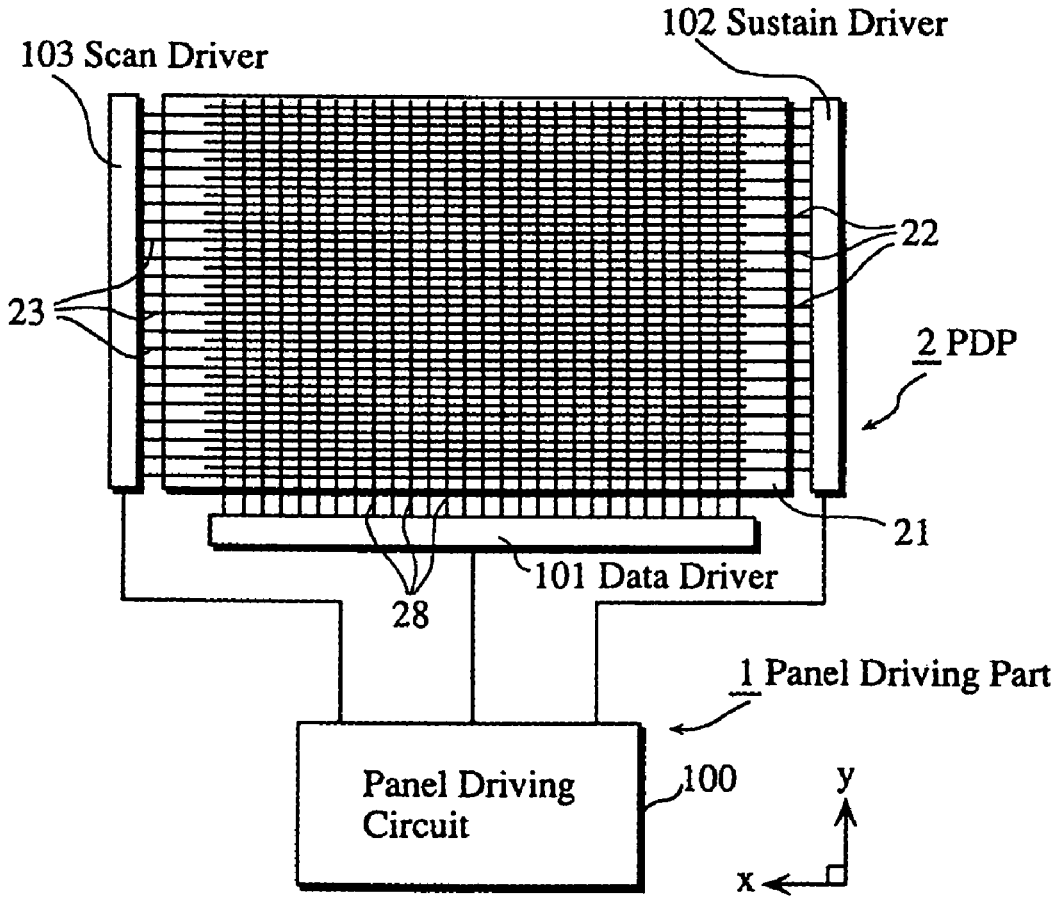
FIG. 2 is a schematic view of the panel driving part, the display electrodes, and so on, of the first embodiment.

FIG. 2 is a schematic view of the front panel glass 21 arranged with display electrodes 22 and 23, and the panel driving part 1 connected to both the display electrodes 22 and 23 and the address electrodes 28. The panel driving part 1 shown in FIG. 2 has a common construction comprising a data driver 101 connected to the address electrodes 28, a sustain driver 102 connected to each of the Y electrodes 22, a scan driver 103 connected to each of the X electrodes 23, and a driving circuit 100 controlling the drivers 101~103. Each of the drivers 101~103 control the flow of electricity to each of the electrodes 22, 23, and 28, connected respectively, and the driving circuit 100 forms an umbrella controlling the drivers 101~103 so as to generate a favorable image display on the PDP 2.

Figure 3:
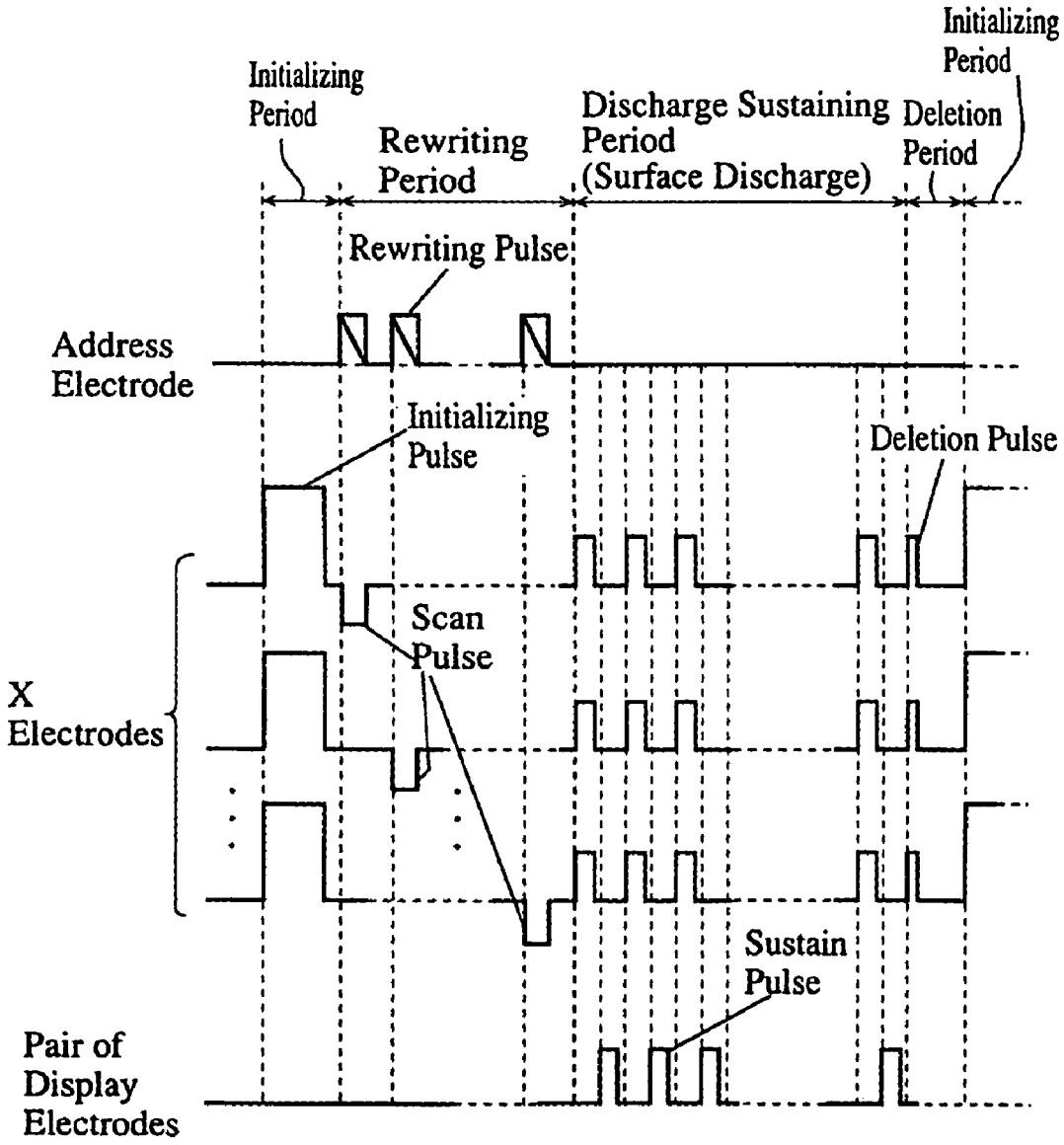
FIG. 3 shows the driving process of the panel driving part of the first embodiment.

The basic process by which the panel driving part 1, comprising the above construction 100~104, drives the PDP 2 will now be explained with reference to the pulse wave diagram in FIG. 3. First, the panel driving part 1 applies an initializing pulse via the scan driver 103 to each of the X electrodes 23 and initializes an electric charge (wall electric charge) existing within each of the cells 340. Via the scan driver 103 and the data driver 101, the panel driving part 1 then simultaneously applies a scan pulse to the X electrode 23 positioned at the top of the panel and a rewriting pulse to the address electrodes 28 corresponding to the cells 340 contributing to image display, thus generating a rewriting discharge and storing wall electric charge on the surface of the dielectric layer 24.

Next, via the scan driver 103 and the data driver 101, the panel driving part 1 simultaneously applies a scan pulse to the X electrode 23 positioned second from the top of the panel and a rewriting pulse to the address electrodes 28 corresponding to the cells 340 contributing to image display, thus generating a rewriting discharge and storing wall electric charge on the surface of the dielectric layer 24.

By applying a continuous scan pulse, the panel driving part 1 continues, in the above manner, to serially store, on the surface of the dielectric layer 24, a wall electric charge corresponding to the cells 340 contributing to image display, and thus rewrite the latent image of each screen image of the PDP 2.

The panel driving part 1 then grounds the address electrodes 28 and applies a sustain pulse via the scan driver 103 and the sustain driver 102 to all of the display electrodes 22 and 23 in isolation so as to generate a sustain discharge (surface discharge). As a result of the electric potential of the surface of the dielectric layer 24 exceeding the discharge firing voltage, discharge is generated within the cells 340 having wall electric charge stored on the surface of the dielectric layer 24, and the discharge (surface discharge) is sustained for the period that the sustain pulse is applied (the discharge sustaining period shown in FIG. 3).

Then, via the scan driver 103, the panel driving part 1 applies a narrow pulse to the X electrodes 23, thereby generating an imperfect discharge and eliminating the wall electric charge. Deletion of the screen image follows (deletion period). The panel driving part 1 generates image display on the PDP 2 through a repetition of this process.

The structure of the panel driving part 1 of the PDP display apparatus and the entire PDP 2, as well as their basic functions have been described above. The characteristics of the first embodiment relate mainly to the display electrodes 22 and 23.

Figure 4:
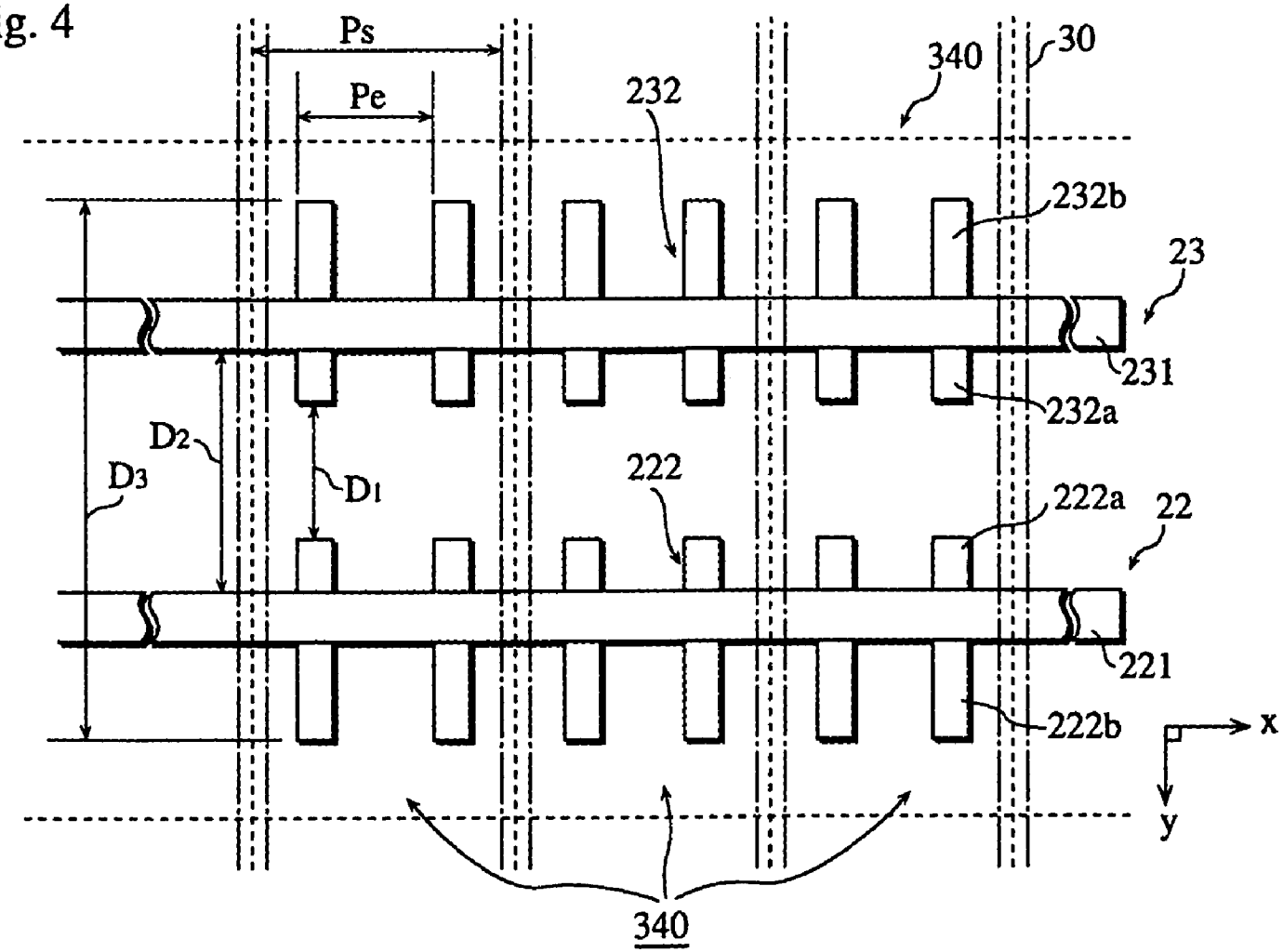
FIG. 4 is a frontal illustration of the display electrodes of the PDP of the first embodiment.

FIG. 4 is a frontal illustration of a section of the front panel of the PDP 2 as viewed from the z direction (i.e. from above the PDP). In FIG. 4, the area of the cells 340 is the area marked out within the broken lines. The cell pitch in the x direction (Ps) and y direction is 360 μm and 1080 μm, respectively, and one square pixel (1080 μm×1080 μm) corresponding to the colors RGB is formed by any three cells 340 lying next to each other in the x direction. In the interest of simplification, the address electrodes 28 have not been shown in FIG. 4 through FIG. 21.

As shown in FIG. 4, each pair of display electrodes 22 and 23 (Y electrodes 22, X electrodes 23) comprise bus electrodes (bus lines) 221 and 231 formed from metal strips 40 μm wide and extending in the x direction, and isolated rectangular-shaped electrodes 222 and 232 extending in the y direction. According to the given example, the gap $D_2$ between each pair of adjacent bus lines is 90 μm.

The isolated electrodes 222 and 232 are composed of indium tin oxide (ITO), which is a material commonly used for transparent electrodes, and according to the given example, the isolated electrodes 222 and 232 have a length (y direction) and width (x direction) of 135 μm and 40 μm, respectively, and a thickness (z direction) of 0.1~0.2 μm. The isolated electrodes 222 and 232 are arranged on each of the bus lines 221 and 231 so that, within each of the cells 340, two isolated electrodes 222 and 232 are provided on each of the bus line 221 and 231 along the x direction. The isolated electrodes 222 and 232 are arranged so as to be opposed to each other.

The isolated electrodes 222 and 232 provided along each of the bus lines 221 and 231 are arranged so that a pitch (Pe) of two isolated electrodes 222 and 232 adjacent in the x direction is smaller than a cell pitch (Ps). Specifically, the value of Pe is determined according to a relation Pe=A×Ps/n, A being a positive value less than 1 and n being a natural number representing the number of isolated electrodes 222 and 232 provided on each of the bus lines 221 and 231 within each cell 340. According to the first embodiment n=2 and in the given example A=0.9. Consequently, Pe=approx. 160 μm (Pe=0.9×360 μm/2=162 μm≈160 μm). Pe is set according to the relation Pe=A×Ps/n at a smaller value than Ps so as to avoid the possibility of any overlap between isolated electrodes 222 and 232 and barrier ribs 30 resulting from an a PDP 2 manufacturing error whereby the isolated electrodes 222 and 232 are not positioned within each of the cells 340. Also, because the value of Pe decreases proportionately to increases in the value of n, it is possible for a large number of isolated electrodes 222 and 232 to be positioned within each of the cells 340.

Using both edges (in the y direction) of the each of the parallel pairs of bus lines 221 and 231 as margins, the isolated electrodes 222 and 232 are divided into an inner area on the facing side of each pair of parallel display electrodes 22 and 23 and an outer area on the opposite side thereof. In the first embodiment and all following embodiments, and in all of the variations included therein, the isolated electrodes 222 and 232 divided into inner and outer pairs of display electrodes 22 and 23 are referred to, respectively, as inner protrusions 222*a* and 232*a* and outer protrusions 222*b* and 232*b*. According to the present example, the length of the inner protrusions 222*a* and 232*a* and the outer protrusions 222*b* and 232*b* in the y direction is 30 μm and 75 μm, respectively.

While the isolated electrodes 222 and 232 according to the first embodiment are provided along each of the bus lines 221 and 231, this construction is simply for ease of manufacture. Thus it is possible to arrange the inner protrusions 222*a* and 232*a* and the outer protrusions 222*b* and 232*b* separately, without it being necessary to provide the isolated electrodes 222 and 232.

A gap $D_1$ between the inner protrusions 222*a* and 232*a* is determined according to Paschen's Law. Specifically, at the discharge gas pressure mentioned above ($266\times10^3$ Pa), the gap $D_1$ at the minimum discharge firing voltage or a voltage in the near vicinity thereof is set at 30 μm as represented on a Paschen curve plotting the relationship between a Pd product and the pressure of the discharge gas, where P is the pressure of the discharge gas and d is the discharge gap. So as to achieve a sufficient sustain discharge capacity, the maximum gap $D_3$ between the isolated electrodes 222 and 232 is set at 300 μm.

The gap $D_1$ in FIG. 4 has been shown wider than in actuality so as to clearly represent the relationship between the isolated electrodes 222 and 232. Although not shown, a sufficient gap has also being provided between the outer protrusions 222*b* and 232*b* and adjacent cells 340 in the y direction so as to prevent the occurrence of cross talk (this gap being in the 150~200 μm range, for example).

In a PDP display apparatus having the PDP 2 described above, surface discharge is fired within the discharge gap $D_1$, which exists between the tips of two facing inner protrusions 222*a* and 232*a* and which is determined according Paschen's Law, when a feed pulse is applied to the display electrodes 22 and 23 during the discharge period. As shown in FIG. 24, existing constructions of the display electrodes 22 and 23 have commonly comprised bus lines 221 and 231 and transparent electrodes 220 and 230 extending in the x direction and having a width (in the y direction) of 50 μm or greater. When the isolated electrodes 222 and 232 are provided according to the first embodiment of the present invention, however, the voltage (discharge firing voltage) needed to generate the discharge can be kept at a lower level than is the case with existing constructions. Thus a favorable firing discharge is obtained while keeping energy consumption below existing levels.

A surface area of the display electrodes 22 and 23 contributing to the discharge expands to the outer side of the parallel bus lines 221 and 231 when the discharged has been fired and is being sustained. In other words, the discharge generated within the discharge gap $D_1$ expands elliptically from the area of the discharge gap $D_1$ (i.e. the discharge expands elliptically along the y direction) until it reaches the outer protrusions 222*b* and 232*b*. Thus it is possible to secure a discharge capacity contributing to the illumination of cells 340 over a wide area.

Existing constructions of the display electrodes 22 and 23 (FIG. 24) tend to use excess electricity in the vicinity of the barrier ribs 30 for illuminating the cells 340 when band-shaped transparent electrodes 220 and 230 are provided. In comparison, energy savings are possible according to the first embodiment of the present invention because the use of a transparent electrode material for forming the isolated electrodes 222 and 232 is limited to areas that contribute effectively to illuminating the cells 340. The amount of electricity needed for discharging the display electrodes 22 and 23 can, therefore, be reduced.

While Japanese unexamined patent application publications no. 8-250029 and no. 11-86739, and U.S. Pat. No. 5,587,624 disclose a display electrode construction having protrusions, they only disclose for a construction having either inner protrusions or outer protrusions on each pair of bus lines. This existing technology not only differs from the first embodiment of the present invention but it does not allow for the expansion, via the outer protrusions, of the discharge capacity to the outer side of the parallel bus lines nor for the reduction of the discharge firing voltage applied to the inner protrusions.

Also, while Japanese unexamined patent application publication no. 5-266801 discloses technology for conducting a plurality of boring processes in band-shaped transparent electrodes, the bored sections are for attaching the bus lines to the front panel glass, and any reduction in transparent electrode material is not sufficient to be considered an energy saving measure. Consequently, it is not possible for the effects of the first embodiment of the present invention to be gained from this existing technology.

Although not described in detail here, improved illuminance efficiency was recorded under experiment conditions when the width of the isolated electrodes was reduced from 40 μm to 20 μm and two protrusions were provided within each of the cells. Such adjustments are possible according to the first embodiment.

All of the variations of the first embodiment will now be described. Redundant description has been omitted since all significant alteration to the construction described in the first embodiment relate to the display electrodes 22 and 23.

<Variation 1-1>

Figure 5:
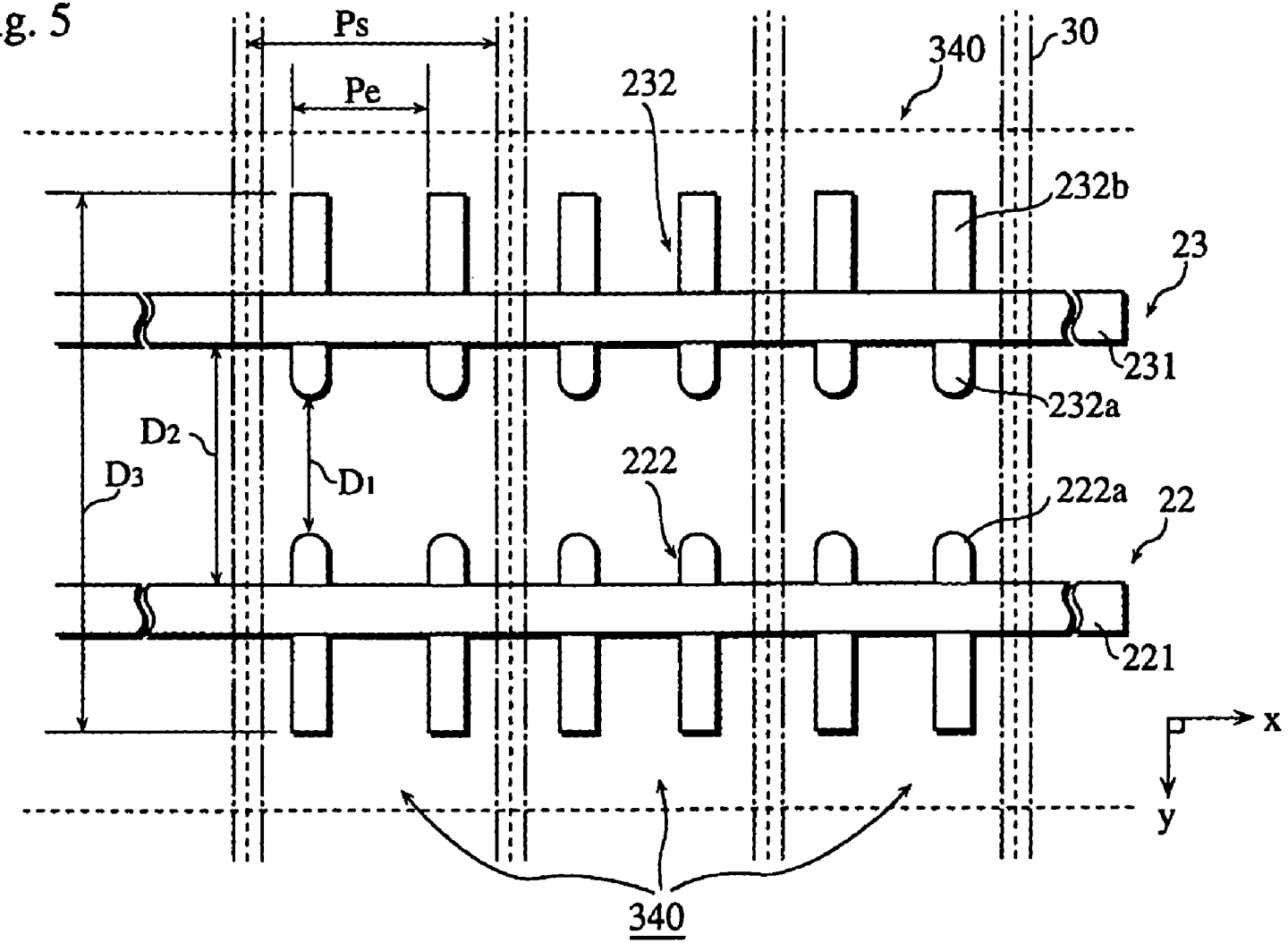
FIG. 5 is a frontal illustration of a variation of the display electrodes (variation 1-1) of the first embodiment.
Figure 6:
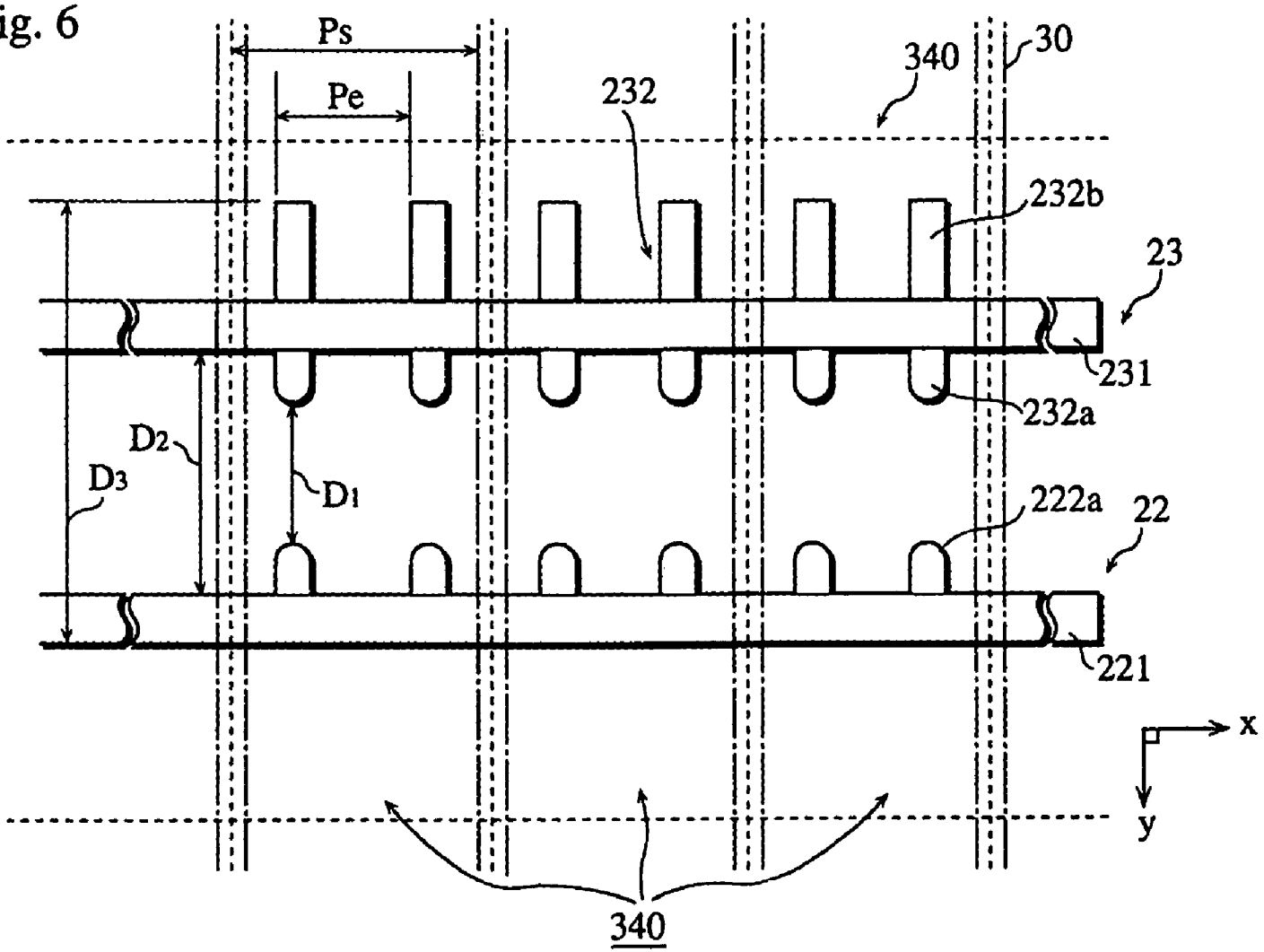
FIG. 6 is a frontal illustration of a variation of the display electrodes (variation 1-2) of the first embodiment.
Figure 7:
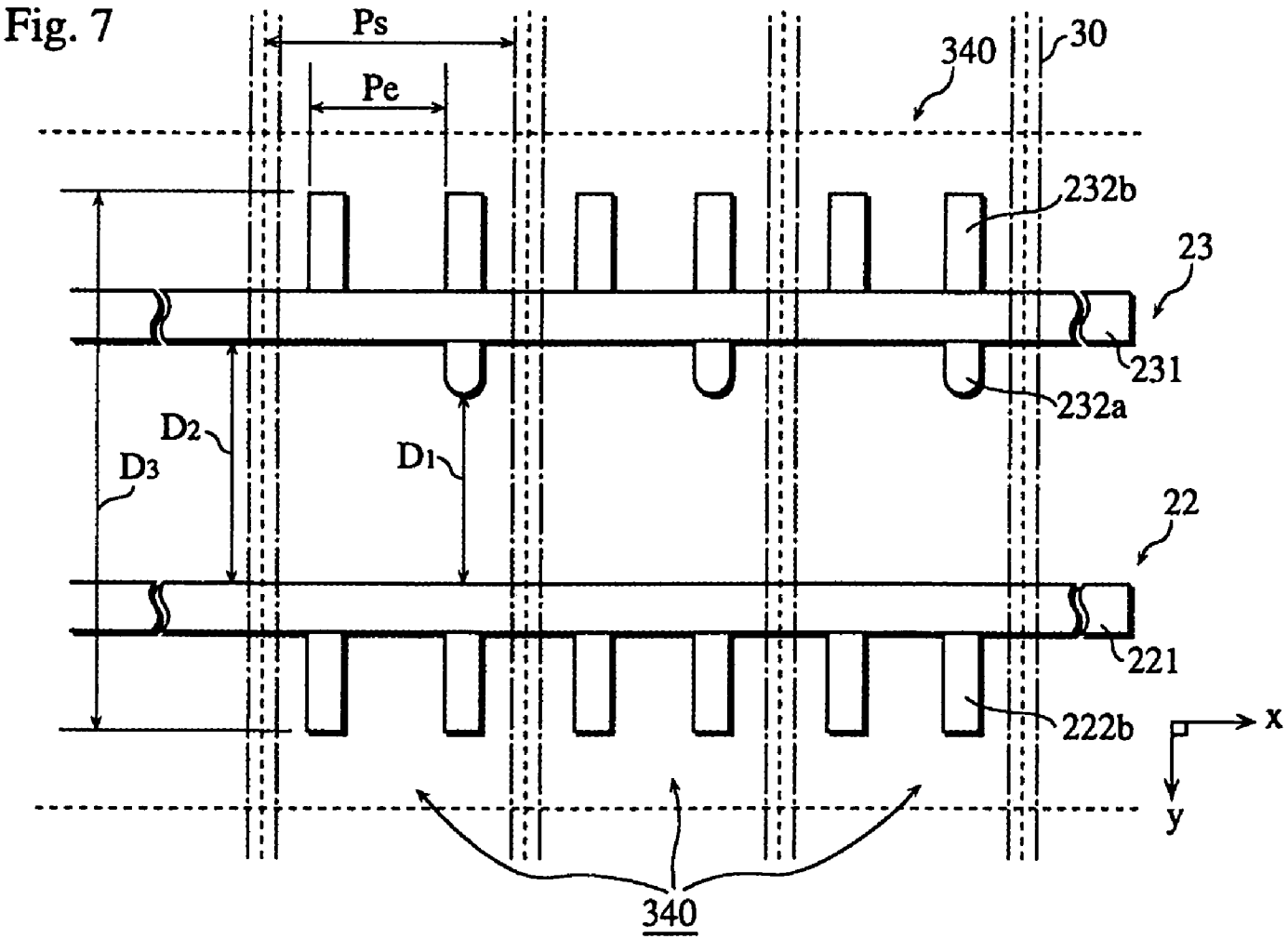
FIG. 7 is a frontal illustration of a variation of the display electrodes (variation 1-3) of the first embodiment.

Effective reductions in the discharge firing voltage can be achieved by concentrating the electric charge (i.e. by increasing the intensity of the electric field) in the area of the display electrodes (the inner protrusions 222*a* and 232*a*) contributing to the firing during the discharge period. FIG. 5 (variation 1-1) is a frontal illustration of display electrodes formed in this way. As shown in FIG. 5, the tips of the inner protrusions 222*a* and 232*a* have been rounded, reducing the surface area. This construction allows for further reductions in the discharge firing voltage because of the favorable way in which the electric charge is concentrated and the resultant easy firing of the discharge.

<Variation 1-2>

Outer protrusions 222*b* and 232*b* need only be provided on one rather than both of the display electrodes 22 and 23. Variation 1-2 shown in FIG. 6 has display electrodes formed in this manner. In variation 1-2, only the outer protrusions 232*b* are provided. It is also possible to provide only the outer protrusions 222*b* instead. Discharge capacity is secured by the outer protrusions 232*b* during the discharge period when they are the only outer protrusions provided.

By arranging outer protrusions (either 222*b* or 232*b*) on only one of the display electrodes (either 22 or 23, respectively) it is possible to decrease the maximum distance $D_3$ between the display electrodes 22 and 23. Thus variation 1-2 provides a construction applicable, for instance, in high-vision televisions having a high definition of cells 340. To further improve the illuminance efficiency of the sustain discharge, the number of outer protrusions 222*b* or 232*b* can be increased and the surface area of the outer protrusions 222*b* or 232*b* can be made larger than that of the inner protrusions 222*a* and 232*a*.

<Variation 1-3>

The inner protrusions 222*a* and 232*a* of the first embodiment need only be arranged on one rather than both of the display electrodes 22 and 23. Variation 1-2 shown in FIG. 7 has display electrodes formed in this manner. In variation 1-2, only the inner protrusions 232*a* are provided and the total number of outer protrusions 222*b* and 232*b* arranged within each of cells 340 is four.

It is possible to provide only the outer protrusions 222*a* instead and to increase the number of the outer protrusions 222*b* and 232*b*. Because the inner protrusions 222*a* are fewer than the outer protrusions 222*b* and 232*b* according to this construction, it is possible to reduce the amount of electricity concentrated in the area of the inner protrusions 222*a* during the discharge period. It is also possible to achieve a sustain discharge across a wide area because of the comparatively wide discharge area secured by the large number of outer protrusions 222*b* and 232*b*. The discharge gap $D_2$ and $D_3$ can also be decreased since the inner protrusions 222*a* are the only inner protrusions provided in variation 1-3. As with variation 1-2, variation 1-3 provides a construction that is compatible with a high definition of cells 340.

<Variation 1-4~1-9>

Figure 8:
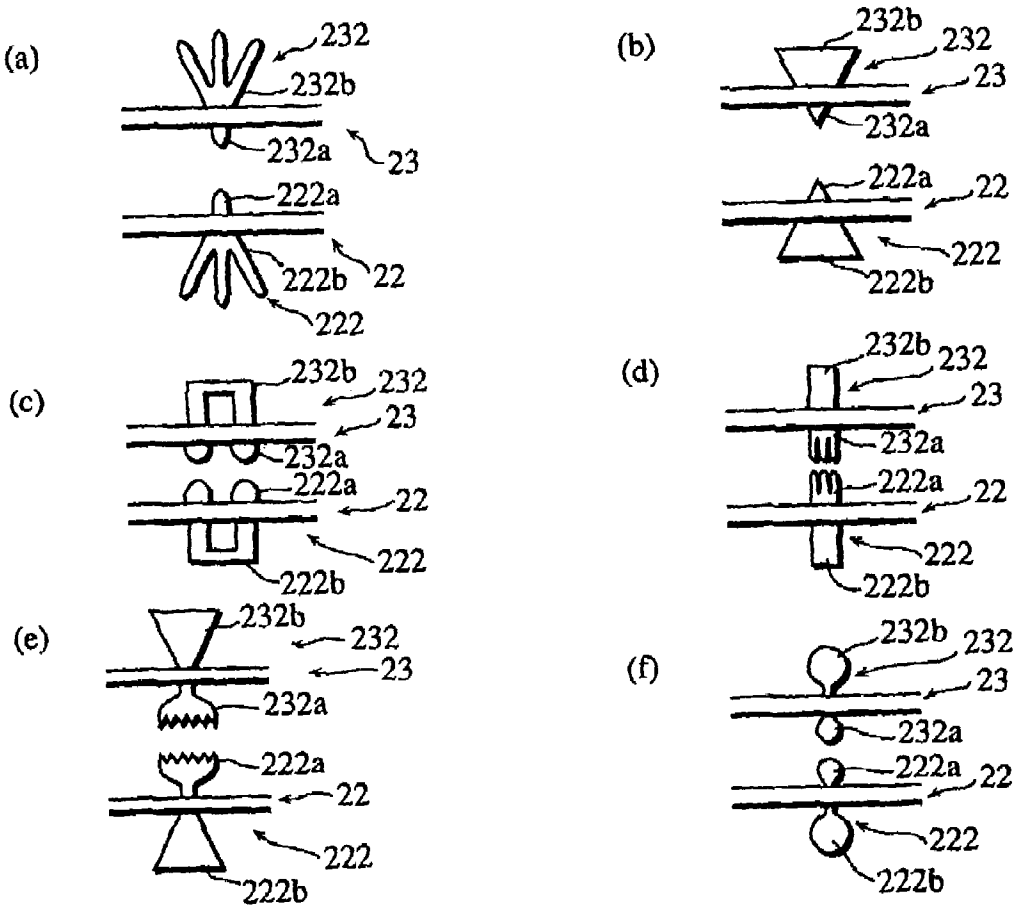
FIG. 8 is a frontal illustration of a variation of the display electrodes (variation 1-4) of the first embodiment.

FIGS. 8(*a*)~(f) show variations 1-4~1-9, respectively, of the first embodiment. In variation 1-4 shown in FIG. 8(*a*), each of the outer protrusions 222*b* and 232*b* are divided into three electrode arms, the pitch (i.e. in an x direction) of the three arms being wider as the distance from the bus line increases. By allowing for the smooth expansion of the discharge capacity, this construction helps reduce the discharge firing voltage and improves the ability to sustain the discharge capacity. The same effect can be gained from the isolated triangular electrodes 222 and 232 of variation 1-5 shown in FIG. 8(*b*) and the isolated array-shaped electrodes 222 and 232 of variation 1-9 shown in FIG. 8(*f*) (the inner protrusions 222*a* and 232*b* being smaller than the outer protrusions 222*b* and 232*b*). Variation 1-7 shown in FIG. 8(*d*) effectively reduces the discharge firing voltage by concentrating the electric charge in the area of the inner electrodes 222*a* and 232*a*. When the ends of the inner protrusions 222*a* and 232*a* are shaped like a fork, the reduced volume and surface area of the inner protrusions 222*a* and 232*a* makes it possible to concentrate the electric charge more effectively. Variation 1-8 shown in FIG. 8(*e*) strikes a balance between reducing the discharge firing voltage and improving the illuminance efficiency by providing inner protrusions 222*a* and 232*a* with fork-shaped ends and outer protrusions 222*b* and 232*b* that are wider in the x direction as the distance from the bus line increases.

According to the first embodiment, it is also possible for the electrode arms of the outer protrusions 222*b* and 232*b* to be joined in the x direction. The construction of variation 1-7 shown in FIG. 8(*c*) is such that the arms of two adjacent outer electrodes 222*b* and 232*b* are joined.

<Variation 1-10~1-12>

The first embodiment is not limited to the example constructions given in the first embodiment and the variations 1-1~1-9 in which the display electrodes 22 and 23 comprise bus lines 221 and 231 and isolated electrodes 222 and 232 (inner protrusions 222*a* and 232*b*, outer protrusions 222*b* and 232*b*).

In variation 1-10 shown in FIG. 9, the display electrodes 22 and 23 comprise bus lines 221 and 231 and transparent electrodes 220 and 230 (snaking electrodes 220 and 230), extending symmetrically in an x direction and snaking in a y direction. The tendency with variation 1-10 is for electricity consumption to increase slightly in comparison to when isolated electrodes 222 and 232 are provided, although this construction does allow for the discharge capacity to be secured over a wider area.

In variation 1-10, the snaking electrodes 220 and 230 on the inner and outer side of the bus lines 221 and 231 are the inner protrusions 222*a* and 232*a* and outer protrusions 222*b* and 232*b*, respectively. The width of the snaking electrodes 220 and 230 is 20~30 μm in the given example. In variation 1-10, the discharge generated at the ends of the inner protrusions 222*a* and 232*a* during the driving period of the PDP 2 expands to the outer protrusions 222*b* and 232*b*. This effect is comparable to that gained in the first embodiment and with variations 1-1 and 1-9 (i.e. a favorable reduction in discharge firing voltage and securing of discharge capacity during the discharge period). For there to be a comparable number of inner protrusions 222*a* and 232*a* and outer protrusions 222*b* and 232*b* as the first embodiment, it is necessary for the snaking electrodes 220 and 230 to have at least 2 to 3 peaks within each of the cells 340.

It is also possible to have the snaking electrodes 220 and 230 stand separately within each of the cells 340. In variation 1-11 shown in FIG. 10, the section of the snaking electrodes 220 and 230 that overlapped with the barrier walls has been eliminated and the remaining section stands separately within each of the cells 340. According to this construction it is possible to further reduce the amount of electricity applied to the snaking electrodes 220 and 230 in comparison to variation 1-10.

In variation 1-12 shown in FIG. 11, the display electrodes 22 and 23 are snaking electrodes composed only of a metal. Although variation 1-12 maintains a construction providing inner protrusions 222*a* and 232*a* and outer protrusions 222*b* and 232*b*, the non-use of transparent electrode material makes it possible to realize large reductions in the electricity applied to the display electrodes 22 and 23.

Second Embodiment

FIG. 12 is a frontal illustration of the display electrodes of the PDP 2 of the second embodiment. FIG. 12 shows a construction having only one isolated electrode arranged on each of the bus lines 221 and 231 within each cell 340. It is, however, possible to arrange two isolated electrodes per cell, as in the first embodiment, in which case it is desirable to arrange the isolated electrodes 222 and 232 to satisfy the relation $Pe=A\times Ps/n$.

In the second embodiment, the isolated electrodes 222 and 232 are arranged, as in the first embodiment, according to Paschen's Law, this time to have a gap (shortest gap $D_1$) of 40 μm therebetween. As shown in FIG. 13, the squared ends of each of the inner protrusions 222*a* and 232*a* are out of alignment in the x direction. The inner protrusions 222*a* and 232*a* can be arranged, as in FIG. 12, so that central lines A and B running in the y direction are out of alignment. The "central lines" referred to here are the lines dividing the surface of the inner protrusions 222*a* and 232*a* in half (FIG. 12). The reason for having the isolated electrodes 222 and 232 out of alignment with each other will now be discussed.

As shown in the enlarged illustration of the display electrodes in FIG. 13, it is possible, during the discharge sustaining period, to have the discharge expand from the shortest gap $D_1$ along the flat surface of the panel of the PDP 2 (i.e. in both the x and y directions, the direction of the discharge in FIG. 13 forming the axis). In a PDP display apparatus have the above construction, the electric charge is concentrated close to the inner electrodes 222*a* and 232*a* when the sustain pulse is applied to the plural pairs of display electrodes 22 and 23, as in the first embodiment. Discharge is then fired in the gap $D_1$ using a lower discharge firing voltage then existing technology. As a surface area of the display electrodes 22 and 23 contributing to the discharge gradually spreads to the outer side of the parallel bus lines 221 and 231 during the discharge period, the discharge capacity expands in the x and y directions (along the surface of the panel), as shown in FIG. 13.

According to the second embodiment, it is possible to improve the expansion of the discharge capacity, particularly in the x direction, beyond the levels achievable by the first embodiment by arranging the inner protrusions 222*a* and 232*a* on each of the bus lines 221 and 231 so as to be out of alignment. The discharge generated in the discharge gap $D_1$ expands beyond the bus lines 221 and 231 to the largest discharge gap $D_3$, and surface discharge is thus conducted over a wide area.

In order to realize the effect of the second embodiment shown in FIG. 13 (i.e. reduction of the discharge firing voltage and securing of the discharge capacity) it is necessary to have the isolated electrodes 222 and 232 out of alignment by a distance equal to or greater than a width of thereof, and to arrange the isolated electrodes 222 and 232 so that no part of the squared ends thereof face each other along the x direction. If a section of the squared ends are to face each other, this section should be kept at 10 μm or below. According to the second embodiment, it is possible to gain the predetermined effect (i.e. an expansion of discharge capacity) by arranging the inner protrusions 222*a* and 232*a* on each of the bus lines 221 and 231 so as to be out of alignment, even when outer protrusions 222*b* and 232*b* are not provided.

<Variation 2-1>

In the second embodiment, the isolated electrodes 222 and 232 of the display electrodes 22 and 23 have squared ends. In variation 2-1 shown in FIG. 14, however, the inner protrusions 222*a* and 232*a* have tapered ends that are half-moon shaped. In this case, the shortest gap $D_1$ exists between the tips of the tapered ends of the inner protrusions 222*a* and 232*a* arranged on opposing bus lines 221 and 231. Because of the favorable discharge capacity in the x and y directions that can be secured during the discharge sustaining period when the ends of the inner protrusions 222*a* and 232*a* are tapered, it is desirable to arrange the inner protrusions 222*a* and 232*a* on each of the bus lines 221 and 231 so that the narrowed ends are out of alignment by 10 μm or more.

<Variations 2-2 and 2-3>

Variation 2-2 as shown in FIG. 15 has, within each of the cells 340, two outer protrusions provided on each the bus lines 221 and 231. This construction is possible according to the second embodiment. The increased number of outer protrusions 222*b* and 232*b* helps expand the capacity of the surface discharge over a wide area during the discharge sustaining period.

In variation 2-3 shown in FIG. 16, outer protrusions (232*b*) are only arranged on one of the bus lines (231). This construction therefore allows the size of each of the cells 340 to be reduced, which means that variation 2-3, as with variation 1-3, is able to achieve the excellent illuminance efficiency required, for example, by high-vision television having a high definition of cells.

<Variation 2-4~2-9>

Variations 2-4~2-9 shown in FIGS. 17(*a*)~(*f*), respectively, have the same shaped isolated electrodes 222 and 232 as variations 1-4~1-9 in FIGS. 8(*a*)~(*f*), the difference being that the isolated electrodes 222 and 232 arranged on each of the display electrodes 22 and 23 in FIGS. 17(*a*)~(*f*) are out of alignment with each other, as per the second embodiment. A combination of the effects of variations 1-4~1-9 and the second embodiment can be achieved with variations 2-4~2-9 (i.e. securing a favorable discharge capacity while improving the illuminance efficiency).

<Variation 2-10>

In variation 2-10 shown in FIG. 18, the isolated electrodes 222 and 232 arranged on each of the bus lines 221 and 231 differ from each other in shape and size. The width of isolated electrodes 222 are 2.5 times the width of the isolated electrodes 232, and the isolated electrodes 222 and 232 are arranged, as in the first embodiment, so that the squared ends do not face each other. An excellent discharge capacity can be secured according to this construction because of the favorable way in which the surface discharge expands in the x direction during the discharge sustaining period.

<Variation 2-11>

While variation 2-11 shown in FIG. 19 maintains the basic construction of variation 2-10, a section of the isolated electrodes 222 or 232 (232 in the given example) is arranged so as to overlap with the barrier ribs 30. This construction aims to make use of an adjacent-surface discharge generated in the vicinity of barrier ribs 30 during the discharge sustaining period.

According to this construction, discharge is initially generated between the inner protrusions 222*a* and 232*a* during the discharge period. In addition to the discharge generated between the isolated electrodes 222 and 232, discharge (referred to as "adjacent-surface discharge") is also generated along the surface (insulating surface) of the barrier ribs 30 at the protrusions 232, which overlap with the barrier ribs 30, during the discharge sustaining period. Combining the adjacent-surface discharge with the surface discharge in the manner of variation 2-11 allows a surface discharge capacity to be achieved over a wide area. The discharge firing voltage can also be kept below existing levels because of the adjacent-surface discharge being fired by an avalanche of field emission-generated secondary electrons. Variation 2-11 thus has excellent energy saving potential. Variation 2-11 is compatible with variation 2-10, as well as other variations.

<Variation 2-12>

Variation 2-12 shown in FIG. 20 maintains the basic construction of variation 2-10, although the degree to which the central lines A and B of the isolated electrodes 222 and 232 are out or alignment is reduced. The effect achieved with this construction is comparable to that of the second embodiment shown in FIG. 12. The predetermined effect can therefore be achieved irrespective of the degree to which the isolated electrodes 222 and 232 (especially the inner protrusions 222*a* and 232*a*) are out of alignment according to the second embodiment.

<Variation 2-13>

Based on the construction of variation 1-10 (FIG. 9) of the first embodiment, variation 2-13 shown in FIG. 21 has snaking electrodes 220 and 230, the wavelength of which are in phase with one another. In variation 2-13, the discharge is generated in the shortest gap $D_1$ during the discharge period and gradually expands to the outer protrusions 222*b* and 232*b* during the succeeding discharge sustaining period. In variation 2-13, the expansion of the discharge in the x and y directions occurring from the snaking electrodes 220 and 230, which are arranged on each of the bus lines 221 and 231 so as to be out of alignment in the x direction, is comparable to the expansion of discharge shown in FIG. 13. Thus it is possible to secure a favorable discharge capacity and improve the illuminance efficiency.

In variation 2-13, it is possible to arrange the snaking electrodes 220 and 230 so as to be slightly more out of alignment (i.e. slightly out of phase). However, having the snaking electrodes 220 and 230 arranged so as to be in phase with each another means that the inner protrusions 222*a* and 232*a* provided on each of the bus lines 221 and 231 are evenly distanced from each another and a healthy discharge gap $D_1$ is maintained, as shown in FIG. 21. With this construction it is therefore possible to achieve a favorable discharge capacity as a result of a single inner protrusion 222*a* being able to generate discharge with the two closest inner protrusions 232*a* separated by a uniform distance from the single inner protrusion 222*a*.

As in variation 1-11 of the first embodiment, it is possible in variation 2-13 to have the snaking electrodes 220 and 230 arranged so as to stand separately within each of the cells 340. Also, as in variation 1-12 of the first embodiment, it is possible to have no bus lines 221 and 231 and for the display electrodes 22 and 23 to be composed of a metal. Variation 2-13 is compatible for use with the third embodiment and the gas discharge device 400, both of which are discussed below.

Third Embodiment

The construction of the display electrodes 22 and 23 of the third embodiment is the same as that of the first embodiment (see FIG. 4). The characteristics of the third embodiment relate mainly to the construction of the insulating layer 25. FIG. 22 is a cross-sectional view of a section of the thickness (in the z direction) of the PDP 2 of the third embodiment.

According to the construction of the PDP 2 shown in FIG. 22, an insulating layer 251 of magnesium oxide (MgO) is formed over an area corresponding to the inner protrusions 222*a* and 232*a* (i.e. the area directly above the inner protrusions 222*a* and 232*a* in FIG. 22), and an insulating layer 252 of aluminum oxide ($Al_2O_3$) is formed over the remaining area, both insulating layers 252 and 253 being formed so as to cover over the dielectric layer 24 which covers the entire surface of the front panel glass 21. The use of both magnesium oxide and aluminum oxide in the third embodiment results in the rate of electron discharge of the insulating layers 251 being higher than that of the insulating layer 252.

Because the rate of electron discharge of the magnesium oxide insulating layer 251 is higher than that of the aluminum oxide insulating layer 252, it becomes easier to generate a discharge in the shortest discharge gap $D_1$ corresponding to the insulating layer 251. Thus it is possible to keep the discharge firing voltage below existing levels.

Discharge is also generated over the insulating layer 252 when each of the cells 340 have become filled with electrons and the discharge is being sustained. At this time, according to the third embodiment, the discharge of extra electrons not effective for illumination is suppressed to a greater extent than is the case with existing insulating layer constructions in which the entire insulating layer is composed of magnesium oxide. Thus it is possible to realize reductions in electricity consumption. Discharge capacity in the cells 340 according to the third embodiment is secured at a level comparable to that of the first and second embodiments.

The insulating layer 252 can be composed of materials other than aluminum oxide, such as a glass material. Also, the insulating layer 251 does not have to correspond to the inner protrusions 222*a* and 232*a*. A comparable result is obtained, for example, when the width of the band of the insulating layer 251 in FIG. 22 is expanded so as to include the area corresponding to the discharge gap $D_1$.

In addition to the first embodiment, the third embodiment is also compatible with the second embodiment and any of the variations 1-1~1-12 and 2-1~2-13. According to the third embodiment, it is also possible to form a magnesium oxide layer and an aluminum oxide layer directly on the display electrodes 22 and 23 in the same manner as the insulating layer 25, without forming a dielectric layer 24 composed of a dielectric glass material.

<Methods of Manufacturing a PDP>

What follows is an explanation of the methods of manufacturing the PDP of the first, second, and third embodiments and the variations 1-1~1-12 and 2-1~2-13.

1. Manufacture of the Front Panel

Display electrodes 22 and 23 are formed on a surface of a front panel glass 21 composed of soda lime glass 2.6 mm thick. Transparent electrodes (i.e. the snaking electrodes 220 and 230 and the isolated electrodes 222 and 232 of the embodiments discussed above) are the first to be formed using the following photo-etching process.

A photo-resist (e.g. an ultraviolet light curing resin) is coated over the entire surface of the front panel glass 21 at a thickness of 0.5 μm. A photo mask of a predetermined pattern is then layered on top and ultraviolet light is illuminated, the non-solidified resin being washed away in a processing liquid bath. Then, using a CVD method (chemical evaporation method), the gaps in the resist on the front panel glass 21 are coated with ITO or a similar material used for making transparent electrodes. The snaking electrodes 220 and 230 and isolated electrodes 222 and 232, having a predetermined shape, are obtained by removing the resist using a washing liquid.

Next, bus lines having a thickness of 4 μm and a width of 30 μm are formed using a metal, a main component of which is either silver (Ag) or Cr—Cu—Cr. A screen-printing method is used when the bus lines are composed of silver and an evaporation method or sputtering method is used when the bus lines are composed of Cr—Cu—Cr. The same photo-etching method can be used when the display electrodes 22 and 23 are composed entirely of silver. A dielectric layer 24 is then formed by firing the front panel glass 21 after the entire surface thereof has been coated with a lead glass paste at a thickness of 15~45 m, covering over the display electrodes 22 and 23.

Next, an insulating layer 25 having a thickness of 0.3~0.6 μm is formed on the surface of the dielectric layer 24 using an evaporating method, a CVD method, or a similar method. The insulating layer 25 is usually composed of magnesium oxide (MgO). However, when sections of the insulating layer are composed of a different material (e.g. the combined use of magnesium oxide and aluminum oxide in the third embodiment), the insulating layer 25 is formed by a patterning process using an appropriate metal mask. This completes the manufacturing process of the front panel 20.

2. Manufacture of the Back Panel

Address electrodes 28 having a thickness of 5 μm are formed by using a screen-printing method to coat a conductive material composed mainly of silver in regularly spaced strips on a surface of the back panel glass 27 composed of soda lime glass 2.6 mm thick. The gap between two adjacent address electrodes 28 is set at 0.4 mm or less so as to make the PDP 2 of the present invention compatible with a 40-inch class NTSC method or a VGA method.

A dielectric film 29 is then formed by firing the back panel glass 27 arranged with address electrodes 28 after the entire surface thereof has been applied with a lead glass paste 20~30 μm thick. Next, barrier ribs 30 of a height of 60~100 μm are formed on the dielectric film 29 in the gap between two adjacent address electrodes 28 using the same lead glass material as applied for the dielectric film 29. The barrier ribs 30 can be formed, for example, by repeatedly screen-printing a paste that includes the glass material mentioned above, before the firing process. The phosphor layers 31~33 are then formed by drying and firing the back panel glass 27 after a red (R), green (G), and blue (B) phosphor ink has been coated onto the wall surface of the barrier ribs 30 and the surface of the dielectric film 29 laying between two adjacent barrier ribs (30). Phosphor material commonly used in the manufacture of PDPs is as follows:

| | |
|---|---|
| Red phosphors: | $(Y_xGd_{1-x})\ BO_3:Eu^{3+}$ |
| Green phosphors: | $Zn_2SiO_4:Mn$ |
| Blue phosphors: | $BaMgAl_{10}O_{17}Eu^{3+}$ (or $BaMgAl_{14}O_{23}:Eu^{3+}$) |

The phosphor material can be a powder having an mean particle size of 3 μm. While there are several methods of applying the phosphor ink, the method used in the given example involves emitting phosphor ink from an extremely fine nozzle while forming a meniscus (a bridge generated by surface tension). Using this method the phosphor ink is applied evenly to the specified area. Other methods such as the screen-printing method can be employed instead. This completes the manufacturing process of the back panel 26.

While the front panel glass 21 and the back panel glass 27 were described above as being composed of soda lime glass, this was simply by way of example and other materials can be used.

3. Completing the PDP

The front panel 20 and back panel 26 are adhered together using an adhesive glass. A high vacuum ($8\times10^{-4}$ Pa) is created within the discharge space 38, and the discharge space 38 is then filled at a predetermined pressure (approx. $266\times10^3$ Pa according to the given example) with a discharge gas, a main component of which is either Ne—Xe, He—Ne—Xe, or He—Ne—Xe—Ar. Experiment results show that the illuminance efficiency is improved when the pressure of the gas at the time of insertion is within a $1\times10^5$ ~$5.3\times10^5$ Pa range.

<Related Matters>

The present invention is described above using examples that are compatible with a gas discharge panel (PDP). However, the present invention can also be applied for use in other devices (gas discharge devices) apart from gas discharge panels. The construction shown in FIG. 23 is an example of one such gas discharge device. In the gas discharge device 400 shown in FIG. 23(*a*), glass covers 401*a* and 401*b*, which have semi-circular cylindrical outer shells, cover both surfaces of a substrate 401, which is arranged on one surface with display electrodes 422 and 423 (Y electrode 422, X electrode 423). The glass covers 401*a* and 401*b* are adhered to the substrate 401 and the space within is then filled with a discharge gas. Discharge is generated within the discharge gas when a voltage is applied to the display electrodes 422 and 423. As shown in FIG. 23(*b*), each of the display electrodes 422 and 423 have electrode prongs 4220 and 4230 formed in a ctenidium pattern, and the display electrodes 422 and 423 are arranged so as to extend across the electrode prongs 4220 and 4230. The electrode prongs 4220 4230 are electrode bases (or bus lines) upon which the inner protrusions 232*a* and outer protrusions 232*b* can be suitably arranged. The present invention is applicable to the display electrodes 422 and 423 of the gas discharge device 400 and similar gas discharge devices.

INDUSTRIAL APPLICABILITY

The gas discharge panel of the present invention can be used, for example, as a display panel for a television receiver.

The invention claimed is:

1. A gas discharge panel having (a) a plurality of cells arranged in a matrix, each cell being filled with a discharge gas which is enclosed between a facing pair of substrates, and a plurality of barrier ribs interposed between the pair of substrates, and (b) plural pairs of display electrodes arranged on an inner surface of one of the substrates so as to extend in a row direction of the matrix across the cells, wherein image display is generated by a discharge fired between the plural pairs of display electrodes, each pair of display electrodes comprising:

two bus lines, being parallel to each other and extending in the row direction of the matrix;

one or more inner protrusions, being arranged within each cell on an inner side of one or both of the bus lines so as to protrude toward an inner side of an opposite bus line;

one or more outer protrusions, being arranged within each cell so as to protrude from an outer side of one or both of the bus lines, at least a section of each of the inner and outer protrusions being positioned between two adjacent barrier ribs, wherein the inner the inner surface of the substrate arranged with the plural pairs of display electrodes is covered with an insulating layer, an area of the insulating layer that corresponds to a shortest discharge gap being composed of magnesium oxide and a remaining area thereof being composed of a material having a lower electron emission rate than magnesium oxide.

2. The gas discharge panel of claim 1, wherein a relation $Pe=A\times Ps/n$ is satisfied in relation to the two bus lines, Pe being a pitch of either the inner or outer protrusion, Ps being a pitch of the cells along the row direction of the matrix, A being positive value less than 1, and n being a natural number.

3. The gas discharge panel of claim 1, wherein the bus lines are composed of a metal and the inner and outer protrusions are composed of a transparent electrode material.

4. The gas discharge panel of claim 1, wherein the outer protrusions extend in a column direction of the matrix, a surface area of each of the outer protrusions being greater than a surface area of each of the inner protrusions.

5. The gas discharge panel of claim 4, wherein a width of each of the outer protrusions along the row direction of the matrix is wider as a distance from the bus line increases.

6. The gas discharge panel of claim 1, wherein a width of an end section of each of the inner protrusions along the row direction of the matrix is narrower than a base section thereof.

7. The gas discharge panel of claim 1, wherein a shortest discharge gap between the panel pairs of display electrodes corresponds to a minimum discharge firing voltage or a voltage in a vicinity thereof as shown on a Paschen curve plotting a relationship between a Pd product and a discharge firing voltage, P being a pressure of the discharge gas and d being a discharge gap.

8. The gas discharge panel of claim 1, wherein the material having a lower electron emission rate than magnesium oxide is aluminum oxide.

9. The gas discharge panel of claim 1, wherein the inner protrusions are provided on each of the two bus lines, the ends of the inner protrusions arranged on each of the bus lines being out of alignment along the row direction of the matrix, and the outer protrusions being arranged so that the discharge fired between the plural pairs of display electrodes expands from the inner protrusions to the outer protrusions.

10. The gas discharge panel of claim 3, wherein the bus lines are composed of silver.

11. The gas discharge panel of claim 9, wherein the outer protrusions are formed unitarily with the bus line and the inner protrusions.

12. A gas discharge panel having (a) a plurality of cells arranged in a matrix, each cell being filled with a discharge gas which is enclosed between a facing pair of substrates, and a plurality of barrier ribs interposed between the pair of substrate, and (b) plural pairs of display electrodes arranged on an inner surface of one of the substrates so as to extend in a row direction of the matrix across the cells, wherein image display is generated by a discharge fired between the plural pairs of display electrodes, each pair of display electrodes comprising:

two bus lines, being parallel to each other and extending in the row direction of the matrix;

one or more inner protrusions, being arranged within each cell on an inner side of one or both of the bus lines so as to protrude toward an inner side of an opposite bus line;

one or more outer protrusions, being arranged within each cell so as to protrude from an outer side of one or both of the bus lines, at least a section of each of the inner and outer protrusions being positioned between two adjacent barrier ribs, wherein the inner protrusions are provided on each of the two bus lines, the ends of the inner protrusions arranged on each of the bus lines being out of alignment along the row direction of the matrix, and the outer protrusions being arranged so that the discharge fired between the plural pairs of display electrodes expands from the inner protrusions to the outer protrusions.

13. The gas discharge panel of claim 12, wherein the inner protrusions have tapered ends along the row direction of the matrix, the tapered ends of any two closest facing inner protrusions being out of alignment by 10 μm or more along the row direction of the matrix.

14. The gas discharge panel of claim 12, wherein a plurality of barrier ribs are formed between the pair of substrates along a column direction of the matrix, at least a section of the inner protrusions overlapping with the barrier ribs.

15. The gas discharge panel of claim 12, wherein the outer protrusions extend in a column direction of the matrix, a surface area of each of the outer protrusions extend in a column direction of the matrix, a surface area of each of the outer protrusions being greater than a surface area of each of the inner protrusions.

16. The gas discharge panel of claim 12, wherein a width of each of the outer protrusions along the row direction of the matrix is wider as the distance from the bus line increases.

17. The gas discharge panel of claim 12, wherein a shape of the inner protrusions arranged on each of the bus lines is different.

18. The gas discharge panel of claim 12, wherein a shortest discharge gap between the plural pairs of display electrodes corresponds to a minimum discharge firing voltage or a voltage in a vicinity thereof as shown on a Paschen curve plotting a relationship between a Pd product and a discharge firing voltage, P being a pressure of the discharge gas and d being a discharge gap.

19. The gas discharge panel of claim 12, wherein the inner surface of the substrate arranged with the plural pairs of display electrodes in covered with an insulating layer, an area of the insulating layer that corresponds to a shortest discharge gap being composed of magnesium oxide and a remaining area thereof being composed of a material having a lower electron emission rate than magnesium oxide.

20. The gas discharge panel of claim 19, wherein the material having a lower electron emission rate than magnesium oxide is aluminum oxide.

21. The gas discharge panel of claim 12, wherein a relation $Pe=A\times Ps/n$ is satisfied in relation to the two bus lines, Pe being a pitch of either the inner or outer protrusions, Ps being a pitch of the cells along the row direction of the matrix, A being a positive value less than 1, and n being a natural number.

22. The gas discharge panel of claim 12, wherein the inner protrusions have squared ends along the row direction of the matrix, the squared ends of any two closest facing inner protrusions being out of alignment such that a width in the row direction of the matrix of a section of the squared ends that face each other is 10 μm or less.

23. A gas discharge panel having (a) a plurality of cells arranged in a matrix, each cell being filled with a discharge gas which is enclosed between a facing pair of substrates and a plurality of barrier ribs interposed between the pair of substrates, and (b) plural pairs of display electrodes composed of a metal and arranged on an inner surface of one of the substrates so as to extend in a row direction of the matrix, wherein image display is generated by a discharge fired between the plural pairs of display electrodes, each pair of display electrodes comprising:

two bases, being parallel to each other and extending in the row direction of the matrix; and one or more inner protrusions, being arranged within each cell on an inner side of each of the bases so as to protrude toward an inner side of an opposite base, the ends of the inner protrusions arranged on each of the bases being out of alignment along the row direction of the matrix.

24. The gas discharge panel of claim 23, wherein the inner protrusions have tapered ends along the row direction of the matrix, the tapered ends of any two closest facing inner protrusions being out of alignment by 10 μm or more along the row direction of the matrix.

25. The gas discharge panel of claim 23, wherein a plurality of barrier ribs are formed between the pair of substrates along a column direction of the matrix, at least a section of the inner protrusions overlapping with the barrier ribs.

26. The gas discharge panel of claim 23, wherein a shape of the inner protrusions arranged on each of the bases is different.

27. The gas discharge panel of claim 23, wherein a shortest discharge gap between the plural pairs of display electrodes corresponds to a minimum discharge firing voltage or a voltage in a vicinity thereof as shown on a Paschen curve plotting a relationship between a Pd product and a discharge firing voltage, P being a pressure of the discharge gas and d being a discharge gap.

28. The gas discharge panel of claim 23, wherein a relation Pe=A×Ps/n is satisfied in relation to the two bus lines, Pe being a pitch of either the inner or outer protrusions, PS being a pitch of the cells along the row direction of the matrix, A being a positive value less than 1, and n being a natural number.

29. The gas discharge panel of claim 23, wherein the inner protrusions have squared ends along the row direction of the matrix, the squared ends of any two closest facing inner protrusions being out of alignment such that a width in the row direction of the matrix of a section of the squared ends that face each other is 10 μm or less.

30. A gas discharge panel having (a) a plurality of cells arranged in a matrix, each cell being filled with a discharge gas which is enclosed between a facing pair of substrates and a plurality of barrier ribs interposed between the pair of substrates, and (b) plural pairs of display electrodes arranged on an inner surface of one of the substrates so as to extend in a row direction of the matrix, each pair of display electrodes comprising:

two bases, being extended in a row direction of the matrix and having a snaky configuration along the plural pairs of display electrodes.

31. The gas discharge panel of claim 30, wherein a wavelength of each of the bases is out of alignment by half a wavelength.

32. The gas discharge panel of claim 30, wherein the bases are composed of a metal.

33. The gas discharge panel of claim 30, wherein the plural pairs of display electrodes are arranged so that a bus line part composed of metal and extending in a row direction of the matrix is connected electrically to each of the bases.

34. The gas discharge panel of claim 33, wherein the bases are composed of a transparent electrode material.

35. A gas discharge panel having (a) a plurality of cells arranged in a matrix, each cell being filled with a discharge gas which is enclosed between a facing pair of substrates and a plurality of barrier ribs interposed between the pair of substrates, and (b) plural pairs of display electrodes arranged on an inner surface of one of the substrates so as to extend in a row direction of the matrix, each pair of display electrodes comprising:

two bus lines, being extended in a row direction of the matrix; and two bases, being connected electrically to and having a snaky configuration along the bus lines, at least a section of the bases being arranged so as to be separate between two adjacent barrier ribs.

36. A gas discharge device having plural pairs of electrodes arranged to face a discharge space filled with a discharge gas wherein a voltage is applied to each of the electrodes so as to fire a discharge between the plural pairs of electrodes and generate illumination, each pair of electrodes comprising:

two electrodes bases, being extended in a same direction;

one or more inner protrusions, being arranged on an inner side of one or both of the electrode bases so as to protrude toward an inner side of an opposite electrode base;

one or more outer protrusions, being arranged so as to protrude from an outer side of one or both of the electrode bases to enable a discharge between the inner protrusions to expand outward to the outer protrusions to provide increased illumination, wherein the ends of the inner protrusions arranged on each of the electrodes bases are out of alignment.

37. The gas discharge panel of claim 36, wherein each pair of electrodes has two electrode bases that extend in a same direction and snake along the one or more pairs of electrodes, a wavelength of each of the electrode bases being out of alignment.

38. A gas discharge panel having (a) a plurality of cells arranged in a matrix, each cell being filled with a discharge gas which is enclosed between a facing pair of substrates, and a plurality of barrier ribs interposed between the pair of substrates, and (b) plural pairs of display electrodes arranged on an inner surface of one of the substrates so as to extend in a row direction of the matrix, wherein image display is generated by a discharge fired between the plural pairs of display electrodes, each pair of display electrodes comprising:

two bus lines, being parallel to each other and extending in the row direction of the matrix;

one or more inner protrusion, being arranged within each cell on an inner side of one or both of the bus lines so as to protrude toward an inner side of an opposite bus line; and one or more outer protrusions, being arranged within each cell so as to protrude from an outer side of one or both of the bus lines, at least a section of each of the inner and outer protrusions being positioned between two adjacent barrier ribs, wherein the inner surface of the substrate arranged with the plural pairs of display electrodes is covered with an insulating layer, an area of the insulating layer that corresponds to a shortest discharge gap being composed of magnesium oxide and a remaining area thereof being composed of a material having a lower election emission rate than magnesium oxide.

39. A gas discharge panel having (a) a plurality of cells arranged in a matrix, each cell being filled with a discharge gas which is enclosed between a facing pair of substrates, and a plurality of barrier ribs interposed between the pair of substrates, and (b) plural pairs of display electrodes arranged on an inner surface of one of the substrates so as to extend in a row direction of the matrix, wherein image display is generated by a discharge fired between the plural pairs of display electrodes, each pair of display electrodes comprising:

two bus lines, being parallel to each other and extending in the row direction of the matrix;

one or more inner protrusions, being arranged within each cell on an inner side of one or both of the bus lines so as to protrude toward an inner side of an opposite bus line; and one or more outer protrusions, being arranged within each cell so as to protrude from an outer side of one or both of the bus lines, at least a section of each of the inner and outer protrusions being positioned between two adjacent barrier ribs, wherein the inner protrusion are provided on each of the two bus lines, the ends of the inner protrusions arranged on each of the bus lines being out of alignment along the row direction of the matrix, and the outer protrusions being arranged so that the discharge fired between the plural pairs of display electrodes expands from the inner protrusions to the outer protrusions.

40. A gas discharge device having one or more pairs of electrodes arranged to face a discharge space filled with a discharge gas, wherein a voltage is applied to each of the electrodes so as to fire a discharge between the one or more pairs of electrodes and generate illumination, each pair of electrodes comprising:

two electrode bases, being extended in a same direction;

one or more inner protrusions, being arranged on an inner side of one or both of the electrode bases so as to protrude toward an inner side of an opposite electrode base; and one or more outer protrusions, being arranged so as to protrude from an outer side of one or both of the electrode bases to enable a discharge between the inner protrusions to expand outward to the outer protrusions to provide increased illumination, wherein each pair of electrodes has two electrodes bases that extend in a same direction and snake along the one or more pairs of electrodes.

41. A gas discharge device having one or more pairs of electrodes arranged to face a discharge space filled with a discharge gas, wherein a voltage is applied to each of the electrodes so as to fire a discharge between the one or more pairs of electrodes and generate illumination, each pair of electrodes comprising:

two electrode bases, being extended in a same direction;

one or more inner protrusions, being arranged on an inner side of one or both of the electrode bases so as to protrude toward an inner side of an opposite electrode base; and one or more outer protrusions, being arranged so as to protrude from an outer side of one or both of the electrode bases to enable a discharge between the inner protrusions to expand outward to the outer protrusions to provide increased illumination, wherein the ends of the inner protrusions arranged on each of the electrode bases are out of alignment.

42. The gas discharge panel of claim 41, wherein each pair of electrodes has two electrode bases that extend in a same direction and snake along the one or more pairs of electrodes, a wavelength of each of the electrode bases being out of alignment.

43. A gas discharge device having plural pairs of electrodes arranged to face a discharge space filled with a discharge gas wherein a voltage is applied to each of the electrodes so as to fire a discharge between the plural pairs of electrodes and generate illumination, each pair of electrodes comprising:

two electrode bases, being extended in a same direction;

one or more inner protrusions, being arranged on an inner side of one or both of the electrode bases so as to protrude toward an inner side of an opposite electrode base; and one or more outer protrusions, being arranged so as to protrude from an outer side of one or both of the electrode bases to enable a discharge between the inner protrusions to expand outward to the outer protrusions to provide increased illumination, wherein each pair of electrodes has two electrode bases that extend in a same direction and snake along the one or more pairs of electrodes.

* * * * *